US006091894A

United States Patent [19]

Fujita et al.

[11] Patent Number: 6,091,894

[45] Date of Patent: Jul. 18, 2000

[54] VIRTUAL SOUND SOURCE POSITIONING APPARATUS

[75] Inventors: Akihiro Fujita; Kenji Kamada; Kouji Kuwano, all of Hamamatsu, Japan

[73] Assignee: Kabushiki Kaisha Kawai Gakki Seisakusho, Shizuoka-ken, Japan

[21] Appl. No.: 08/766,713

[22] Filed: Dec. 13, 1996

[30] Foreign Application Priority Data

| | | | |
|---|---|---|---|
| Dec. 15, 1995 | [JP] | Japan | 7-347992 |
| Dec. 22, 1995 | [JP] | Japan | 7-350468 |
| Dec. 22, 1995 | [JP] | Japan | 7-350469 |
| Jan. 31, 1996 | [JP] | Japan | 8-037310 |

[51] Int. Cl.[7] ..... H04S 7/00; H04S 5/00; G06G 7/62

[52] U.S. Cl. ..... 395/500.34; 381/17

[58] Field of Search ..... 395/500, 500.34; 381/17

[56] References Cited

U.S. PATENT DOCUMENTS

| | | | |
|---|---|---|---|
| 4,356,349 | 10/1982 | Robinson | 381/1 |
| 4,980,914 | 12/1990 | Kunugi et al. | 381/1 |
| 5,301,236 | 4/1994 | Iizuka et al. | 381/17 |
| 5,371,799 | 12/1994 | Lowe et al. | 381/310 |
| 5,500,900 | 3/1996 | Chen et al. | 381/17 |
| 5,546,465 | 8/1996 | Kim | 381/18 |
| 5,572,591 | 11/1996 | Numazu et al. | 381/1 |
| 5,604,809 | 2/1997 | Tsubonuma | 381/17 |
| 5,742,688 | 4/1998 | Ogawa et al. | 381/17 |

FOREIGN PATENT DOCUMENTS

WO9416538 7/1994 WIPO .

*Primary Examiner*—Kevin J. Teska
*Assistant Examiner*—Hugh Jones
*Attorney, Agent, or Firm*—Christie, Parker & Hale, LLP

[57] ABSTRACT

A virtual sound source positioning apparatus includes a channel signal generating section for generating first and second channel signals, a first component signal indicative of a component of the first channel signal, and a second component signal indicative of a component of the second channel signal from an audio input signal, a control section including a low pass filter, for generating a difference signal associated with a difference between the first component signal and the second component signal, filtering the difference signal by the low pass filter to generate a filtered difference signal, and for generating a first audio image control signal from the filtered difference signal and the first channel signal, and a second audio image control signal from the second channel signal and the filtered difference signal, and a sound output section for positioning a virtual sound source in accordance with the first and second audio image control-signals. The difference signal may be generated by multiplying the first and second component signals by predetermined coefficients, and the filtered difference signal may be delayed in accordance with the difference signal transfer paths to the ears of a listener. The first and second channel signals can be generated using two head acoustic transfer functions. In this case, an IIR-type filter is used to generate a direct sound signal and an IIR-type filter and a FIR-type filter connected thereto in series are used to generate a reflection signal.

25 Claims, 26 Drawing Sheets

24

L
R
AMPLITUDE
0
0
4.5ms
21ms
TIME
TIME
DIRECT SOUND SECTION
REFLECTION SOUND SECTION

Fig. 15A
Fig. 15B
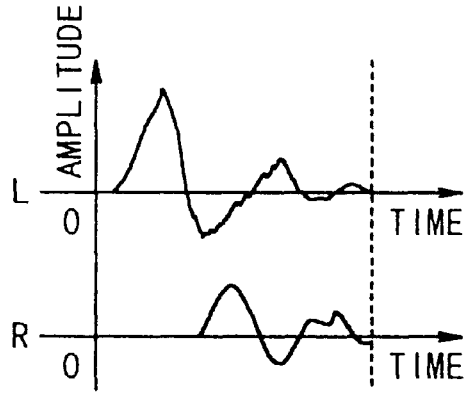
Fig. 16A
Fig. 16B
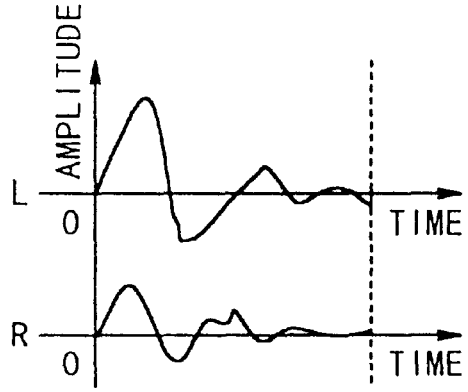
Fig. 17A
Fig. 17B
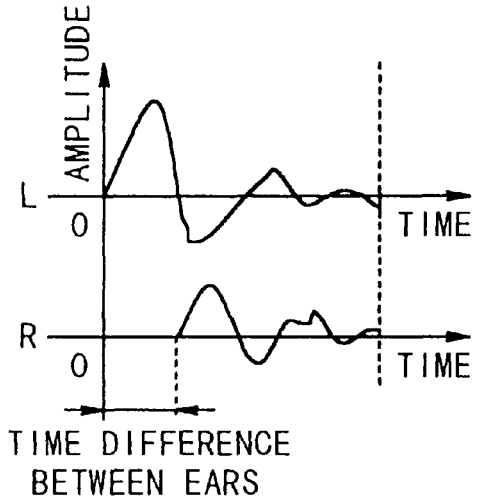

Fig. 18A
Fig. 18B
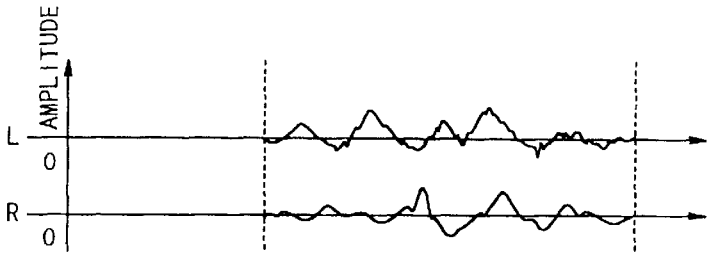
Fig. 19A
Fig. 19B
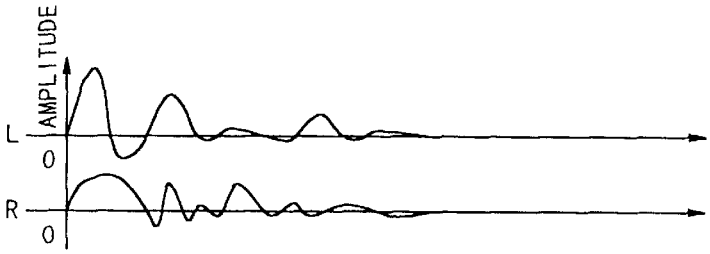
Fig. 20A
Fig. 20B
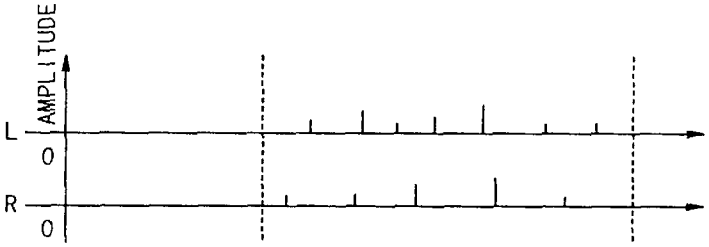
Fig. 21A
Fig. 21B
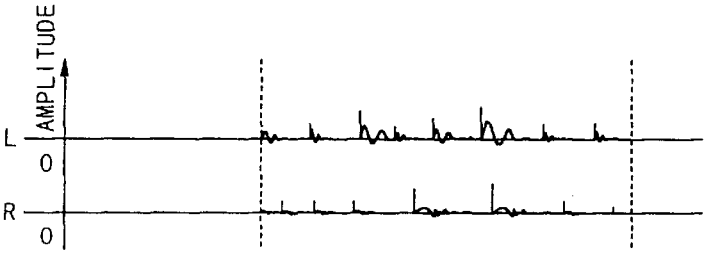
Fig. 22A
Fig. 22B
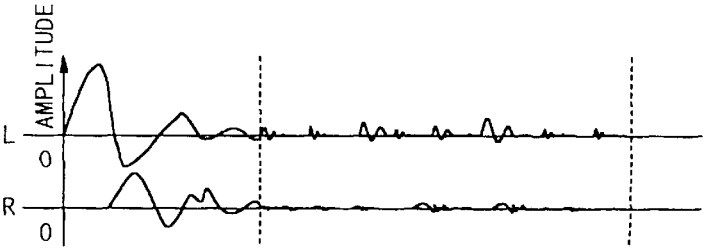

Fig. 34

| JOY STICK | FIRST SIGNAL PROCESSING CIRCUIT | | SECOND SIGNAL PROCESSING CIRCUIT | | |
|---|---|---|---|---|---|
| | ANGLE | WEIGHT COEFFICIENT $K_1$ | ANGLE | WEIGHT COEFFICIENT $K_2$ | |
| 90° | 90° | 1.0 | 80° | 0.0 | INITIAL VALUE |
| MOVE TO DIRECTION OF 80° | | 0.9 | | 0.1 | |
| | | 0.8 | | 0.2 | |
| | | ⋮ | | ⋮ | |
| | | 0.1 | | 0.9 | |
| | | 0.0 | | 1.0 | POSITIONED AT 80° |
| MOVE TO DIRECTION OF 100° | | 0.2 | | 0.9 | |
| | | 1.0 | | 0.8 | |
| | | ⋮ | | ⋮ | |
| | | 0.9 | | 0.1 | |
| | | 1.0 | | 0.0 | (90°) |
| | | | 100° | | SET COEFFICIENTS |
| | | 0.9 | | 0.1 | |
| | | 0.8 | | 0.2 | |
| | | ⋮ | | ⋮ | |
| | | 0.1 | | 0.9 | |
| | | 0.0 | | 1.0 | POSITIONED AT 100° |
| MOVE TO DIRECTION OF 105° | 110° | | | | SET COEFFICIENTS |
| | | 0.1 | | 0.9 | |
| | | 0.2 | | 0.8 | |
| | | ⋮ | | ⋮ | |
| | | 0.5 | | 0.5 | POSITIONED AT 105° |

VIRTUAL SOUND SOURCE POSITIONING APPARATUS

FIELD OF THE INVENTION

The present invention relates to technique for controlling the stereo audio images at an electronic musical instrument, a game machine, a sound equipment and so on.

DESCRIPTION OF RELATED ART

Conventionally, the technique is known in which a left channel audio signal and a right channel audio signal are respectively generated and supplied to left and right speakers such that a virtual sound source is positioned. The technique is referred to as "2 channel speaker reproducing technique". In the conventional virtual sound source positioning technique, the virtual sound source is positioned by mainly changing the balance of sound volumes of the left and right speakers. Therefore, only panning on a horizontal plane is possible. Further, in this virtual sound source positioning technique, the virtual sound source could be positioned only in a middle point between the left and right speakers.

As the technique in which the virtual sound source is positioned by reproducing 2-channel signals by speakers, there is conventionally known the technique in which convolution of a head acoustic transfer function on the time domain and cross talk cancellation are used (for example, see "on RSS", by Roland, Japanese acoustics society magazine, Vol. 48, No. 9). However, in this technique, because a delay FIR filter is used for the convolution of the head acoustic transfer function on the time domain and the cross talk cancellation, an amount of hardware becomes enormous. Therefore, the cross talk could not be completely canceled because of hardware limitations.

Similarly, there is known the technique in which sounds having phases of inverse to each other are mixed such that a virtual sound source is positioned outside the region between two speakers. For example, see "Sound Image Manipulation Apparatus and Method For Sound Image Enhancement", (WO94/16538). Because the range where the virtual sound source can be positioned can be expanded if the technique is used, it is possible to expand a sound field to a great extent. In the conventional technique, a difference signal between a left channel input signal and a right channel input signal is generated. The difference signal is appropriately adjusted in amplitude by use of a potentiometer and then is supplied to a band pass filter. The band pass filter extracts only a predetermined frequency band component to generate a filtered difference signal. The filtered difference signal from the band pass filter is added to one of the channel input signals and to generate a channel audio output signal. Similarly, the filter difference signal from the band pass filter is subtracted from the other channel input signal to a channel audio output signal. The left and right channel audio output signals are supplied to the speakers on left and right sides, respectively. According to the conventional method of extending a region where a virtual sound source can be positioned, the virtual sound source can be positioned at a position other than a region between the speakers.

However, in the virtual sound source positioned range extending apparatus, when a potentiometer is adjusted in such a manner that the position of the virtual sound source is changed, there is a problem in that a signal component having the center frequency of the band pass filter is emphasized to the detriment of the sound quality. In a case of the extreme degradation, there is a case that the left and right channel input signals cannot be reproduced.

In the technique in which the sounds having phases inverse to each other are mixed to position the virtual sound source on a position other than the region between the speakers, it is difficult to position the virtual sound source at an arbitrary position. Also, it is difficult to position the virtual sound source at a position far from a listener. Also, in this technique, there is a problem in that the virtual sound source cannot be positioned at a position outside of the head of the listener when the audio signals are reproduced by headphones.

Further, in the conventional virtual sound source positioning range extending apparatus, the movement of the virtual sound source position is achieved by replacing various coefficients corresponding to a current virtual sound source position by new various coefficients corresponding to a new virtual sound source position. However, according to the method, if the virtual sound source position is moved by a large distance, there is a problem in that noise is generated because sound signals to be generated changes rapidly.

SUMMARY OF THE INVENTION

Therefore, the object of the present invention is to provide a stereo virtual sound source positioning apparatus without degradation of sound quality.

Another object of the present invention is to provide a virtual sound source positioning apparatus which can position a virtual sound source on a position outside of the listener's head for a headphone listener and at a position outside of the region between the speakers for a listener who listens to sound from a speaker system, with sound spreading and reality which cannot be obtained by the aforementioned conventional techniques.

Still another object of the present invention is to provide a virtual sound source positioning apparatus in which a virtual sound source position can be smoothly moved while suppressing the generation of noise.

In order to achieve an aspect of the present invention, a virtual sound source positioning apparatus includes a channel signal generating section for generating first and second channel signals, a first component signal indicative of a component of the first channel signal, and a second component signal indicative of a component of the second channel signal from an audio input signal, a control section including a low pass filter, for generating a difference signal associated with a difference between the first component signal and the second component signal, filtering the difference signal by the low pass filter to generate a filtered difference signal, and for generating a first audio image control signal from the filtered difference signal and the first channel signal, and a second audio image control signal from the second channel signal and the filtered difference signal, and a sound output section for positioning a virtual sound source in accordance with the first and second audio image control signals.

In this case, the control section further includes a multiplying section for multiplying the first and second component signals by predetermined multiplication coefficients to generate first and second multiplication component signals, respectively. The difference signal is indicative of a difference between the first and second multiplication component signals. Also, the control section further includes a delay section for delaying the filtered difference signal by predetermined delay times to generate delayed filtered difference signals for the first and second audio image control signals, respectively. The first and second audio image control signals are generated from the first and second channel signals and the delayed filtered difference signals, respectively.

The first channel signal is a first composite sound signal of a first direct sound signal and a first reflection sound signal and the second channel signal is a second composite sound signal of a second direct sound signal and a second reflection sound signal. The first component signal may be the first channel signal and the second component signal may be the second channel signal. Alternatively, the first component signal may be the first direct sound signal and the second component signal may be the second direct sound signal. In either case, the channel signal generating section includes a first signal processing section for processing the audio input signal using a first head acoustic transfer function to generate the first composite sound signal as the first channel signal composed of the first direct sound signal and the first reflection sound signal, and a second signal processing section for processing the audio input signal using a second head acoustic transfer function to generate the second composite sound signal as the second channel signal composed of the second direct sound signal and the second reflection sound signal. Also, the first signal processing section includes a first j-th order IIR-type filter ($0<j\leqq 10$) for generating the first direct sound signal, and the second signal processing section includes a second j-th IIR-type filter for generating the second direct sound signal. The first signal processing section includes a first k-th order IIR-type filter ($0<k\leqq 10$) for generating the first reflection sound signal, and a first m-th order FIR-type filter ($0<m$) which is connected in series with the first k-th IIR-type filter, and the second signal processing section includes a second k-th order IIR-type filter for generating the second reflection sound signal, and a second m-th order FIR-type filter which is connected in series with the second k-th IIR-type filter.

In order to achieve another aspect of the present invention, a virtual sound source positioning apparatus includes a channel signal generating section which is composed of a first processing section for generating first and second channel signals and first and second component signals respectively indicative of components of the first and second channel signals from an audio input signal, and a second processing section for generating third and fourth channel signals and third and fourth component signals respectively indicative of components of the third and fourth channel signals from the audio input signal, wherein a ratio of the first channel signal to the third channel signal is k1:k2, and a ratio of the second channel signal to the fourth channel signal is k1:k2, a control section for generating a difference signal associated between a summation of the first component signal and the third component signal and a summation of the second component signal and the fourth component signal, generating a first audio image control signal from a first signal relating to the difference signal, the first channel signal and the third channel signal, and generating a second audio image control signal from a second signal relating to the difference signal, the second channel signal and the fourth channel signal, and a sound output section for positioning a virtual sound source in accordance with the first and second audio image control signals. The channel signal generating section may further include a weighting section of weighting the audio input signal such that the ratio of the first channel signal to the third channel signal is k1:k2 and the ratio of the second channel signal to the fourth channel signal is k1:k2. Alternatively, the channel signal generating section further include a weighting section of weighting the first to fourth channel signals such that the ratio of the first channel signal to the third channel signal is k1:k2 and the ratio of the second channel signal to the fourth channel signal is k1:k2. When the virtual sound source is positioned on a first position, k1=1 and k2=0 and the first processing section is set in a first state corresponding to the first position. In this case, the virtual sound source positioning apparatus further includes an instructing section for issuing an instruction to move the virtual sound source from the first position to a second position, a setting section for setting the second processing section to a second state corresponding to the second position in response to the instruction, and a changing section for changing the k1 and k2 such that a relation of (k1+k2=1) is satisfied.

In order to achieve still another aspect of the present invention, a virtual sound source positioning apparatus includes a first signal processing section for processing an audio input signal using a first head acoustic transfer function to generate a first composite sound signal composed of a first direct sound signal and a first reflection sound signal, a second signal processing section for processing the audio input signal using a second head acoustic transfer function to generate a second composite sound signal composed of a second direct sound signal and a second reflection sound signal, and a sound output for positioning a virtual sound source in accordance with the first and the second composite sound signals.

BRIEF DESCRIPTION OF THE DRAWINGS

FIGS. 15A and 15B are diagrams illustrating direct sound portions of head impulse responses of the head acoustic transfer function which are measured in FIGS. 14A and 14B;

FIGS. 16A and 16B are diagrams illustrating the waveforms when the waveforms which are shown by FIGS. 15A and 15B are approximated with an IIR-type filter;

FIGS. 17A and 17B are diagrams illustrating the waveforms when the waveforms shown by FIGS. 16A and 16B are transformed, considering the time difference to both ears;

FIGS. 18A and 18B are diagrams illustrating the direct sound portions of the head impulse responses of the head acoustic transfer function which are measured in FIGS. 14A and 14B;

FIGS. 19A and 19B are diagrams illustrating the waveforms when the waveforms shown in FIGS. 18A and 18B are approximated with an IIR-type filter;

FIGS. 20A and 20B are diagrams illustrating the method determining tap coefficients from the waveforms shown in FIGS. 18A and 18B;

FIGS. 21A and 21B are diagrams illustrating the waveforms of reflection sounds which are approximated using the tap coefficients determined in FIGS. 20A and 20B;

FIGS. 22A and 22B are diagrams illustrating the waveforms when the head acoustic transfer function is approximated;

FIG. 34 is a diagram to explain the operation of the virtual sound source positioning apparatus according to the fourth embodiment of the present invention;

DESCRIPTION OF THE PREFERRED EMBODIMENTS

The virtual sound source positioning apparatus of the present invention will be described below in detail with reference to the accompanying drawings.

Figure 1:
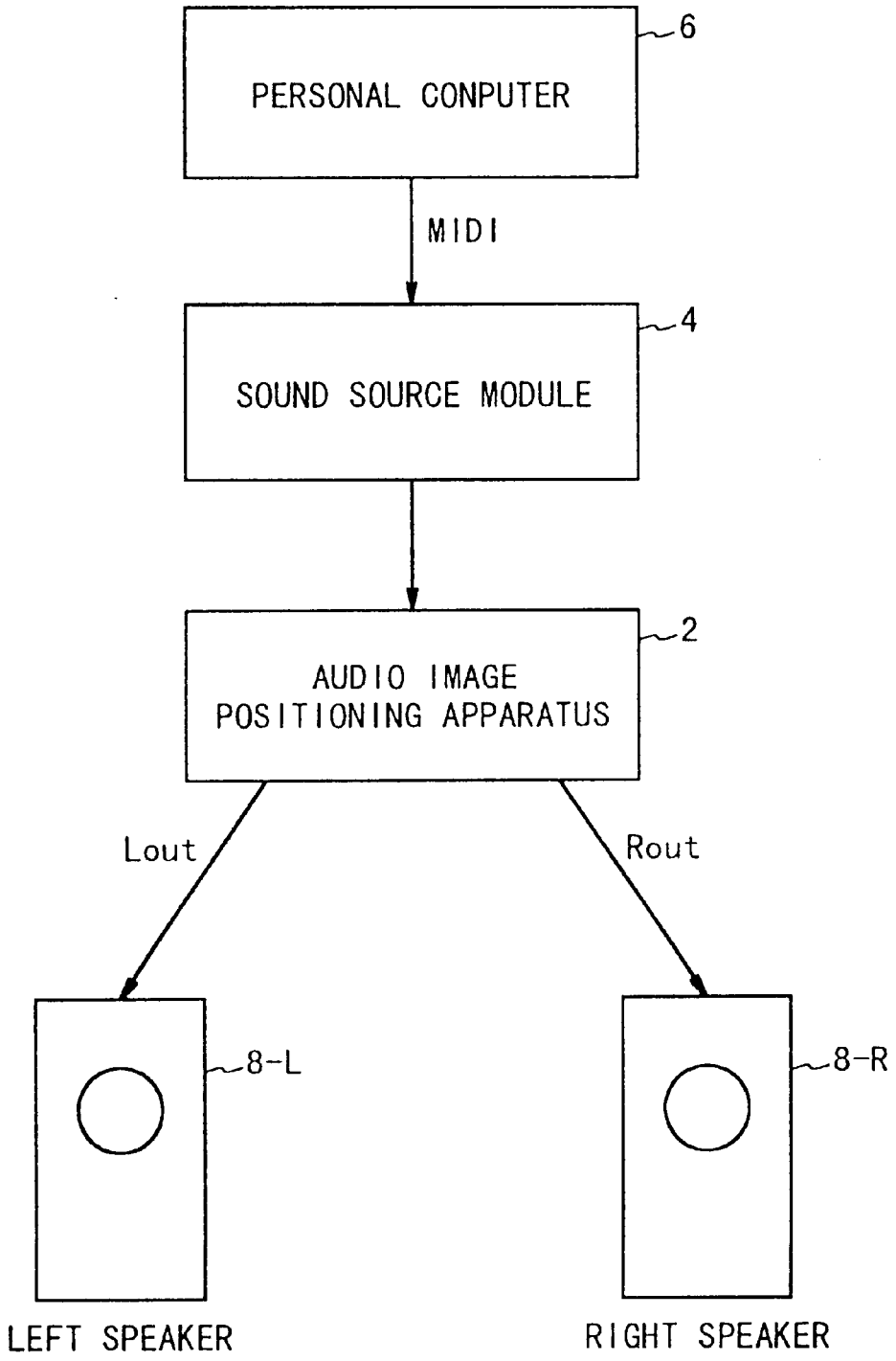
FIG. 1 is a diagram illustrating an example of a sound image apparatus using a virtual sound source positioning apparatus of the present invention.

FIG. 1 is a block diagram illustrating the structure of an audio image apparatus using a virtual sound source positioning apparatus of the present invention. Referring to FIG. 1, a personal computer 6 sends a MIDI data to a sound source module 4. The sound source module 4 generates an audio input signal in accordance with the received MIDI data. The audio input signal is supplied to the stereo virtual sound source positioning apparatus 2 of the present invention. The virtual sound source positioning apparatus 2 generates the audio image signals Lout and Rout and supplies these signals to the left speaker 8-L and the right speaker 8-R, respectively. A virtual sound source formed based on the audio images which are formed by the sounds generated from both the speakers can be positioned at a position other than a region between the speakers 8-L and 8-R.

In the audio image apparatus, the MIDI data is transmitted from the personal computer 6 to the sound source module 4. However, the data to be transmitted is not limited to the MIDI data. Various types of data which can control musical sounds may be transmitted. Also, a unit which can store a musical sound control data, e.g., an electronic musical instrument, a sequencer, or other various equipment may be used instead of the personal computer 6. Further, the unit which generates the audio input signal is also not limited to the sound source module 4. Instead of the sound source module 4, the units such as the electronic musical instrument, the game machine, and the sound units may be used.

Figure 2:
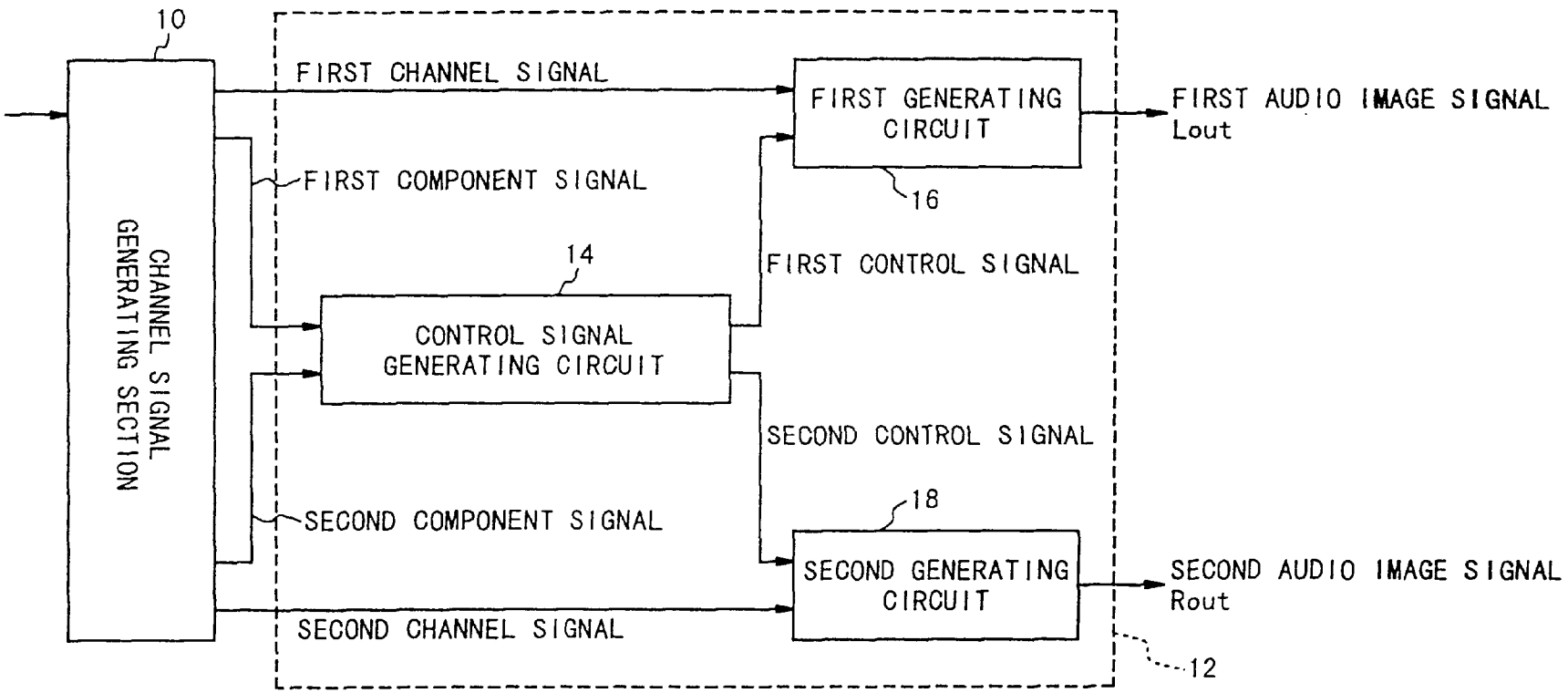
FIG. 2 is a block diagram illustrating a function structure of the virtual sound source positioning apparatus of the present invention.

Next, the basic function structure of the virtual sound source positioning apparatus of the present invention will be described. FIG. 2 is a block diagram illustrating the structure of the virtual sound source positioning apparatus of the present invention. Referring to FIG. 2, the virtual sound source positioning apparatus is composed of a channel signal generating section 10 for generating first and second channel signals and first and second component signals from an audio input signal, and a control section 12. The control section 12 is composed of a control signal generating circuit 14 for generating first and second control signals from the first and second component signals, a first generating circuit 16 for generating a first audio image signal from the first channel signal and the first control signal, and a second generating circuit 18 for generating a second audio image signal from the second channel signal and the second control signal. The channel signal generating section 10, the control signal generating circuit 14, the first generating circuit 16 and the second generating circuit 18 which are all shown in FIG. 2 may be realized by a digital signal processor (DSP).

Figure 3:
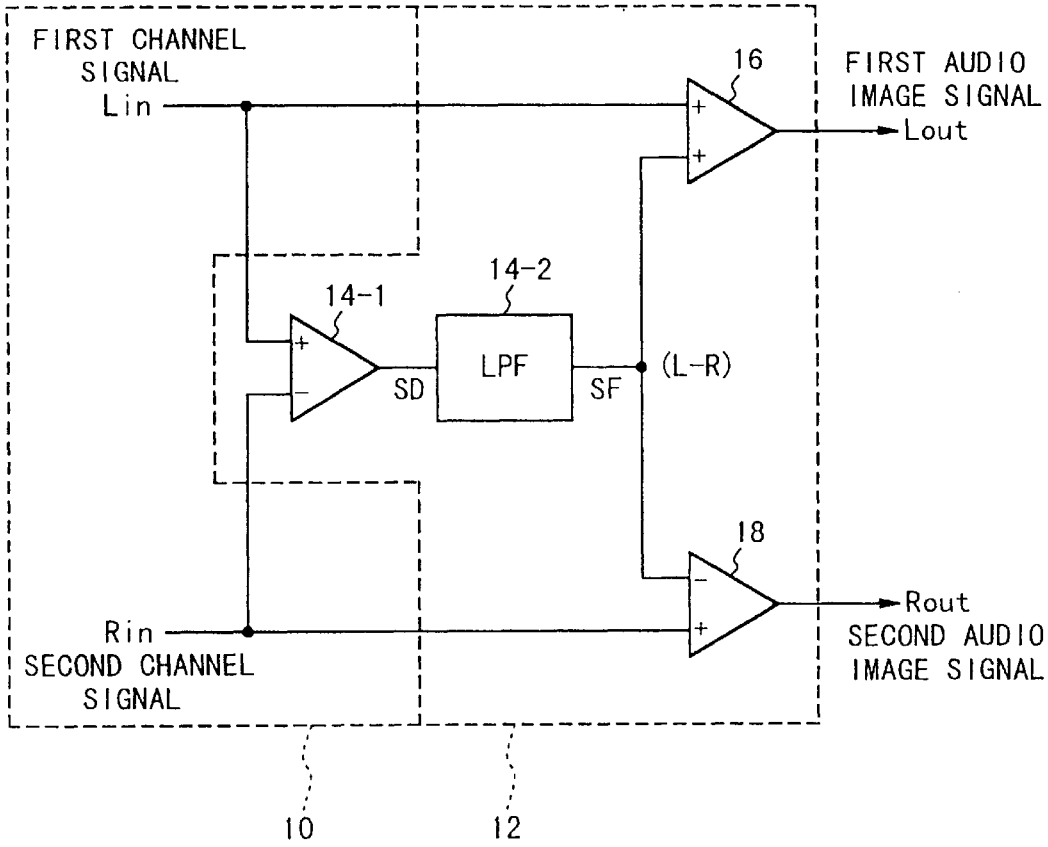
FIG. 3 is a block diagram illustrating the structure of the virtual sound source positioning apparatus according to a first embodiment of the present invention.

Next, the virtual sound source positioning apparatus according to the first embodiment of the present invention will be described. FIG. 3 is a block diagram illustrating the structure of the virtual sound source positioning apparatus in the first embodiment. Referring to FIG. 3, the channel signal generating section 10 generates the first and second channel signals for a left channel and a right channel from the audio input signal to output to the control section 12. Also, the channel signal generating section 10 outputs the generated first and second channel signals to the control section 12 as the first and second component signals. The control section 12 includes the control signal generating circuit 14. The control signal generating circuit 14 is composed of a first calculating circuit 14-1 which subtracts the second component signal from the first component signal to generate a difference signal SD, and a first-order low pass filter (LPF) circuit 14-2 which filters the difference signal SD from the first calculating circuit 14-1 to generate a filtered difference signal SF. The control section 12 is further composed of a second calculating circuit 16 as the first generating circuit which adds the first channel signal and the filtered difference signal from the low pass filter circuit 14-2 to generate the first audio image signal, and a third calculating circuit 18 as the second generating circuit which subtracts the filtered difference signal supplied from the low pass filter circuit 14-2 from the second channel signal to generate the second audio image signal. The low pass filter circuit 14-2 is composed of the first-order low pass filter.

The virtual sound source positioning apparatus in the first embodiment can treat an analog signal or a digital signal. In the virtual sound source positioning apparatus which treats the analog signal, all or part of the first calculating circuits 14-1, low pass filter circuits 14-2, second calculating circuits 16 and third calculating circuits 18 can be constructed in a hardware manner. That is, the first calculating circuit 14-1 may be composed of an operation amplifier when the first channel signal Lin is the analog signal.

In the virtual sound source positioning apparatus which treats the digital signal, all or a part of the first calculating circuits 14-1, low pass filter circuits 14-2, second calculating circuits 16 and third calculating circuits 18 may be constructed by the DSP or software processing executed by a central processing unit (to be referred to as a "CPU", hereinafter).

Suppose that the first channel signal is the left channel signal Lin, the second channel signal is the right channel signal Rin, the first calculating circuit 14-1 subtracts the right channel input signal Rin from the left channel input signal Lin to generate the difference signal SD (=Lin-Rin). This difference signal SD corresponds to the sound when only a strong panning component is extracted. The difference signal SD is supplied to the low pass filter circuit 14-2 which is composed of the first-order low pass filter.

Multiplication sections (not illustrated) for multiplying input signals by predetermined multiplication coefficients may be added before the first calculating circuit 14-1. In this case, the multiplication coefficients are supplied from an external unit, e.g., a CPU (not illustrated). The predetermined multiplication coefficients can be used to increase or decrease the ratio of the first component signal to the second component signal to modify the difference signal SD.

In the first-order low pass filter circuit 14-2, the high frequency component having less phase change is removed from the difference signal SD and the filtered difference signal SF is generated. When the difference signal SD is an analog signal, the well-known filter composed of a resistor R and a capacitor C may be applied as the first-order low pass filter circuit 14-2. Also, when the difference signal SD is a digital signal, a digital filter composed of a delay element, a coefficient multiplier and an adder can be used as the first-order low pass filter 14-2. Further, when the difference signal SD is the digital signal, the functions of the delay element, coefficient multiplier and adder may be realized by the software processing by a DSP or CPU. As the first-order low pass filter 14-2, the IIR-type filter having a cutoff frequency of 700 Hz can be used.

The filtered difference signal SF from the first-order low pass filter circuit 14-2 is supplied to the second calculating circuit 16 and the third calculating circuit 18. The second calculating circuit 16 adds the filtered difference signal SF supplied from the first-order low pass filter circuit 14-2 and the left channel input signal Lin. Therefore, the first audio image signal as a left channel output signal Lout becomes the signal which reflects "2Lin-Rin". On the other hand, the third calculating circuit 18 subtracts the filtered difference signal SF supplied from the first-order low pass filter circuit 14-2 from the right channel input signal Rin. Therefore, the second audio image signal as a right channel output signal Rout becomes the signal which reflects "2Rin-Lin". When the first audio image signal (the left channel output signal) Lout and the second audio image signal (the right channel output signal) Rout which are both generated in this manner are supplied to the speakers 8-L and 8-R, respectively, a virtual sound source can be positioned on a position other than a region between the speakers.

The second or third calculating circuit 16 or 18 may be composed of an operation amplifier when the channel signal is an analog signal and may be constructed with addition processing by a DSP or CPU when the channel signal is a digital signal.

In the above structure, the operation of the virtual sound source positioning apparatus will be described in accordance with the flow of the signal. When the left channel input signal Lin as the first channel signal and the right channel input signal Rin as the second channel signal are inputted from the channel signal generating section 10 to the control section 12, the first calculating circuit 14-1 generates and supplies the difference signal SD to the first-order low pass filter 14-2. The first-order low pass filter 14-2 generates the filtered difference signal SF that the high frequency component of the difference signal SD is removed, and supplies it to the second calculating circuit 16 as the first generating circuit and the third calculating circuit 18 as the second generating circuit.

In the second calculating circuit 16, the filtered difference signal SF is added to the left channel input signal Lin and the left channel output signal Lout as the first audio image signal is generated. Because the filtered difference signal SF is obtained based on "Lin-Rin", the left channel output signal Lout becomes the signal which reflects "2Lin-Rin". Similarly, in the third calculating circuit 18, the filtered difference signal SF is subtracted from the right channel input signal Rin and the right channel output signal Rout as the second audio image signal is generated. The right channel output signal Rout becomes the signal which reflects "2Rin-Lin". In this manner, the region where the stereo audio images can be positioned can be 0 extended.

Figure 4:
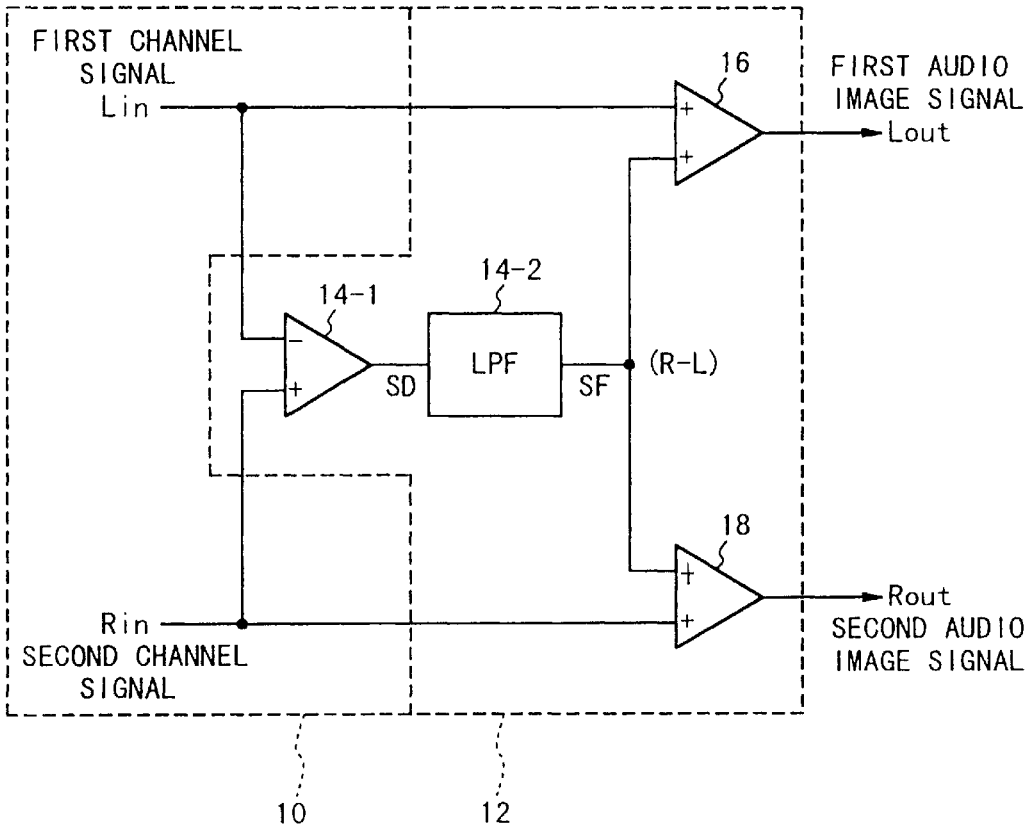
FIG. 4 is a block diagram illustrating the structure of a modification of the stereo virtual sound source positioning apparatus according to the first embodiment of the present invention.

FIG. 4 is a block diagram illustrating the structure of a modification of the virtual sound source positioning apparatus in the first embodiment shown in FIG. 3. In this modification, the first calculating circuit 14-1 subtracts the left channel input signal Lin from the right channel input signal Rin to generate the difference signal SD. The first-order low pass filter circuit 14-2 generates the filtered difference signal SF from the difference signal SD. In the second calculating circuit 16, the left channel output signal Lout is generated with the filter difference signal SF subtracted from the left channel input signal Lin. Because the filtered difference signal SF is obtained based on "Rin-Lin", the left channel output signal Lout becomes the signal which reflects "2Lin-Rin". In the same manner, in the third calculating circuit 18, the right channel output signal Rout is generated with the filter difference signal SF added to the right channel input signal Rin. The right channel output signal Rout becomes the signal which reflects "2Rin-Lin" In this manner, in the modification, because the left channel output signal Lout and the right channel output signal Rout are generated, the same effect can be obtained as described above in the virtual sound source positioning apparatus in the first embodiment.

As described above in detail, according to the virtual sound source positioning apparatus in the first embodiment, because the first-order low pass filter is used as the filter circuit 14-2, the problem of sound quality degradation from an emphasis on the center frequency of the band pass filter is solved, unlike the conventional virtual sound source positioning apparatus.

Also, because the first-order low pass filter is used as the filter circuit 14-2, the structure becomes simple, compared to that of the conventional virtual sound source positioning apparatus. That is, compared to the band pass filter which is used in the conventional virtual sound source positioning apparatus, the amount of hardware required to implement the low pass filter of the present invention is about half. Also, when the low pass filter of the present invention is implemented with software using a DSP or a CPU, the amount of processing required is about one half of the processing required for the conventional band pass filter implementation.

Further, according to the virtual sound source positioning apparatus of the present invention, because the virtual sound source can be positioned at a position other than a region between the speakers for the audio input signal, it is possible for the sound field to be extended substantially.

Figure 5:
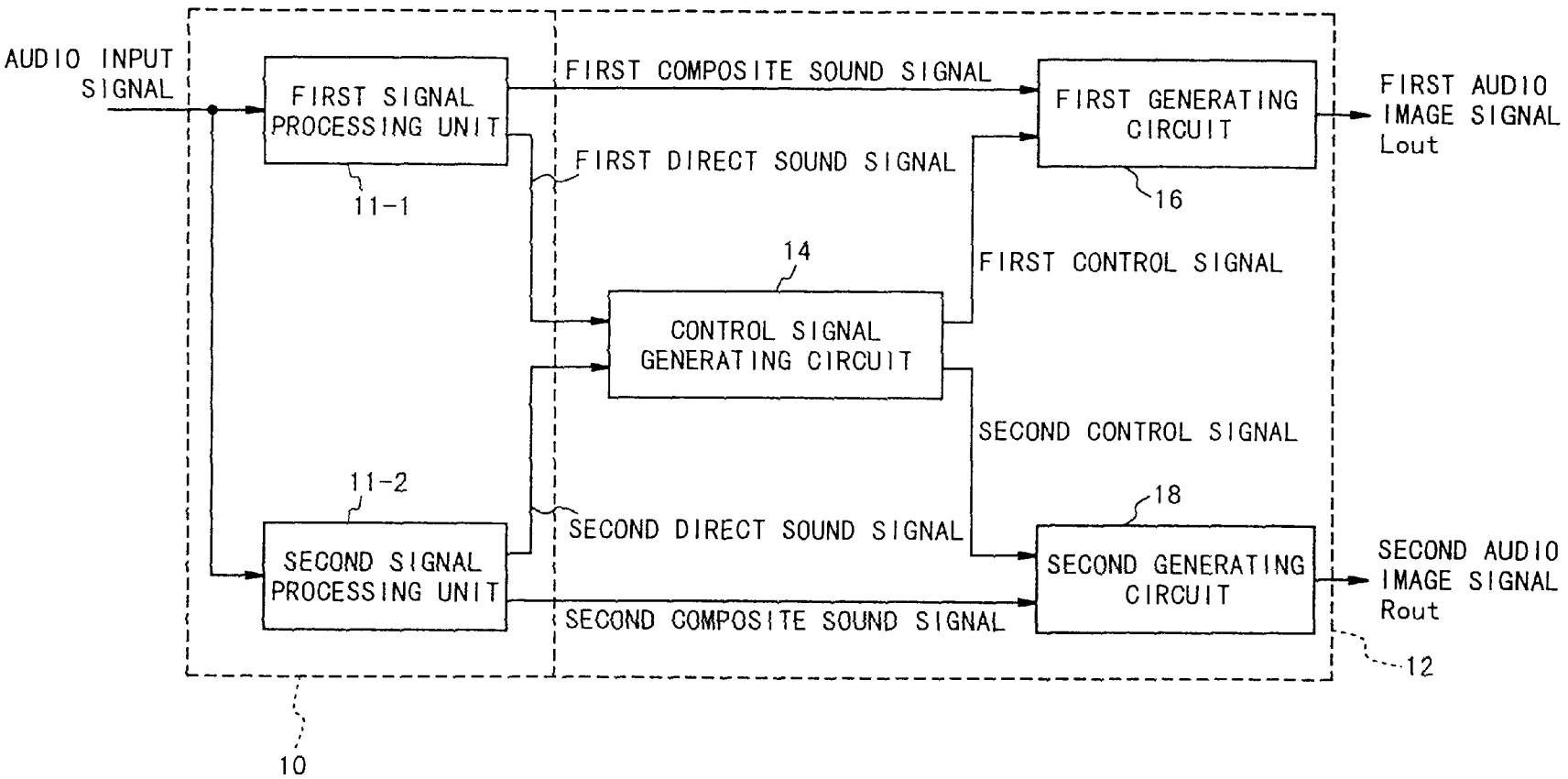
FIG. 5 is a block diagram illustrating the structure of the virtual sound source positioning apparatus according to a second embodiment of the present invention.

Next, the virtual sound source positioning apparatus according to the second embodiment of the present invention will be described. FIG. 5 is a block diagram illustrating the structure of the virtual sound source positioning apparatus according to the second embodiment of the present invention. Referring to FIG. 5, in the virtual sound source positioning apparatus of the second embodiment of the present invention, the channel signal generating section 10 is composed of a first signal processing circuit 11-1 and a second signal processing circuit 11-2. Also, the control section 12 is composed of the control signal generating circuit 14, the first generating circuit 16 and the second generating circuit 18. All the above-mentioned circuits may be realized in a DSP.

In the second embodiment, the first channel signal is the left channel signal and the second channel signal is the right channel signal. The first head acoustic transfer function which is used in the first signal processing circuit 11-1 is a function representative of a transfer system from a sound source to one of the ears (strictly speaking, "eardrum"), e.g., the left ear. The second head acoustic transfer function which is used in the second signal processing circuit 11-2 is a function representative of a transfer system from the sound source to the other ear, e.g., the right ear. The first and second head acoustic transfer functions are simply referred to as the "head acoustic transfer functions" below when both are referred collectively.

The head acoustic transfer function is the transfer function which reflects reflection, diffraction, and resonance of sound at the head, auricle, and shoulder and so on. The head acoustic transfer function can be determined through measurement. The first direct sound signal outputted from the first signal processing circuit 11-1 is the signal indicative of a direct sound which directly reaches from the sound source, e.g., the speaker to one of the ears of a listener. The second direct sound signal outputted from the second signal processing circuit 11-2 is the signal indicative of a direct sound which directly reaches from the sound source to the other ear of the listener. The first or second direct sound is referred to as the "direct sound" when it is referred generally. There are the first and second reflection sounds which reach the ears of the listener after the sound generated from the sound source is reflected by an obstacle, respectively. These first and second reflection sounds are merely generically referred to as the "reflection sounds". An initial reflection sound and a subsequent reflection sound is included in the reflection sound. When a sound is generated from a sound source, the direct sound first reaches the ear of the listener, and then the reflection sound reaches the listener.

The first composite sound signal is the signal which is representative of the first composite sound composed of the first direct sound which reaches one of the ears of the listener from the sound source and the first reflection sound. The second composite sound signal is the signal which is representative of the second composite sound composed of the second direct sound which reaches the other ear of the listener from the sound source and the second reflection sound. These first and second composite sounds are referred to as the "composite sound".

Figure 6:
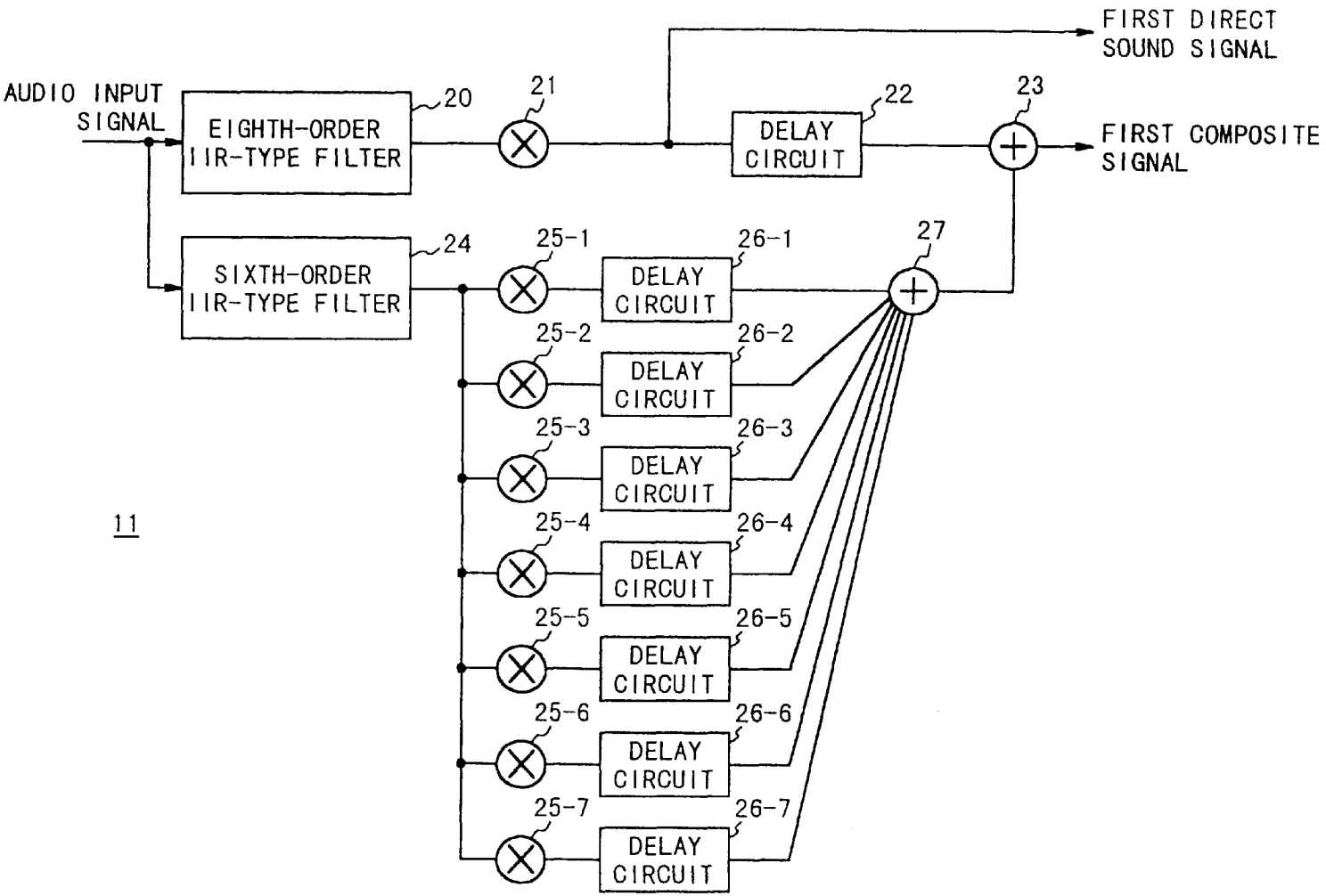
FIG. 6 is a block diagram illustrating the structure of the first signal processing section of FIG. 5.

FIG. 6 is a block diagram illustrating the structure of each of the first signal processing circuit 11-1 and the second signal processing circuit 11-2. The structure of the first signal processing circuit 11-1 is the same as that of the second signal processing circuit 11-2 but coefficients (filter coefficients, multiplication coefficients, delay coefficients) which are given to these circuits are different between the circuits 11-1 and 11-2. That is, the coefficients for approximating the first head acoustic transfer function are given to the first signal processing circuit 11-1 and the coefficients for approximating the second head acoustic transfer function are given to the second signal processing circuit 11-2. Therefore, in the following description, except for the case where it is especially necessary to distinguish one from the other, it is merely generically referred to as the "signal processing circuit 11"

Figure 7:
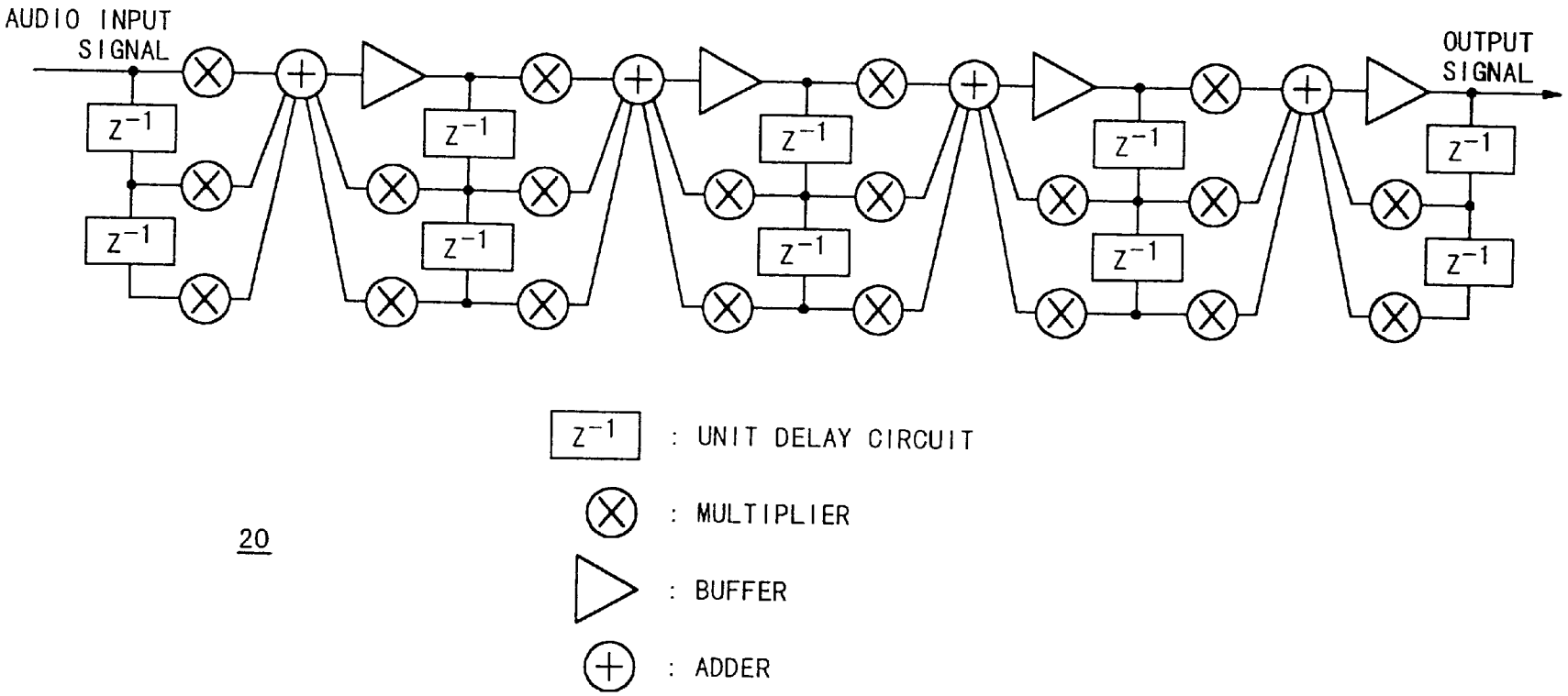
FIG. 7 is a block diagram illustrating the structure of the eighth-order IIR-type filter which is used in the first signal processing section is shown in FIG. 6.

If the signal processing circuit 11 shown in FIG. 6 is roughly classified, it is composed of a direct sound generating system and a composite sound generating system. The direct sound generating system is composed of an eighth-order IIR-type filter 20, a multiplier 21 and a delay circuit 22. FIG. 7 shows an example of structure of the eighth-order IIR-type filter 20. The eight-order IIR-type filter 20 is the well-known filter in which the structures, each of which is called the standard form of an IIR filter system, are connected in series. The multiplier 21 of FIG. 6 amplifies the signal which passed the eighth-order IIR-type filter 20 in accordance with a multiplication coefficient. The output of the multiplier 21 is supplied to the first calculating circuit 14-1 of the control signal generating circuit 14 in the control section 12 as the first or second direct sound signal (the first or second component signal). The delay circuit 22 delays the direct sound signal supplied from the multiplier 21 by the time period determined according to delay coefficients. The signal from this delay circuit 22 is supplied to the adder 23.

Figure 8:
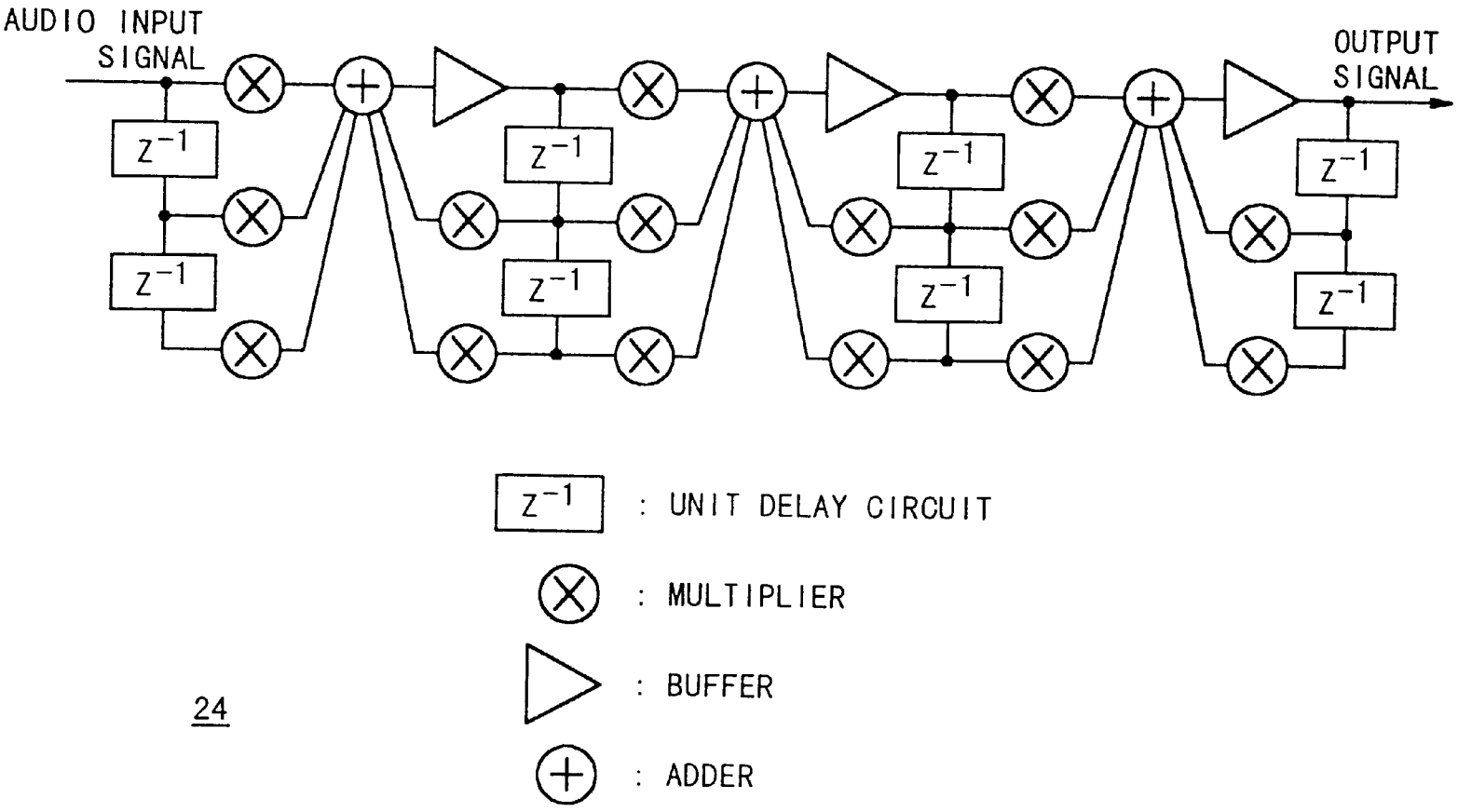
FIG. 8 is a block diagram illustrating the structure of the sixth-order IIR-type filter which is used in the first signal processing section is shown in FIG. 6.

The composite sound generating system of the signal processing circuit is composed of the sixth-order IIR-type filter 24, seven multipliers 25-1 to 25-7 and seven delay circuits 26-1 to 26-7. FIG. 8 shows an example of structure of the sixth-order IIR-type filter 24. The sixth-order IIR-type filter 24 is the well-known filter in which the structures, each of which is called the standard form of the IIR filter system, are connected in series. The multiplier 25-1 to 25-7 amplifies the signal from the sixth-order IIR-type filter 24 respectively according to multiplication coefficients. The outputs of the multiplier 25-1 to 25-7 are supplied to the delay circuit 26-1 to 26-7, respectively. Each of the delay circuits 26-1 to 26-7 delays the signal from a corresponding multiplier by the time period determined in accordance with a delay coefficient and supplies to an adder 27. The adder 27 adds the signals from all the delay circuits 26-1 to 26-7. The output of the adder 27 is supplied to an adder 23. The adder 23 adds the signal of the direct sound generating system from the delay circuit 22 and the signal of the reflection sound generating system from the adder 27. Thus, the direct sound and the reflection sound are synthesized so that the first composite sound signal is generated in which the characteristic of the first head acoustic transfer function is given to the input signal (the first channel signal) or the second composite sound signal is generated in which the characteristic of the second head acoustic transfer function is given to the input signal (the second channel signal).

Figure 9:
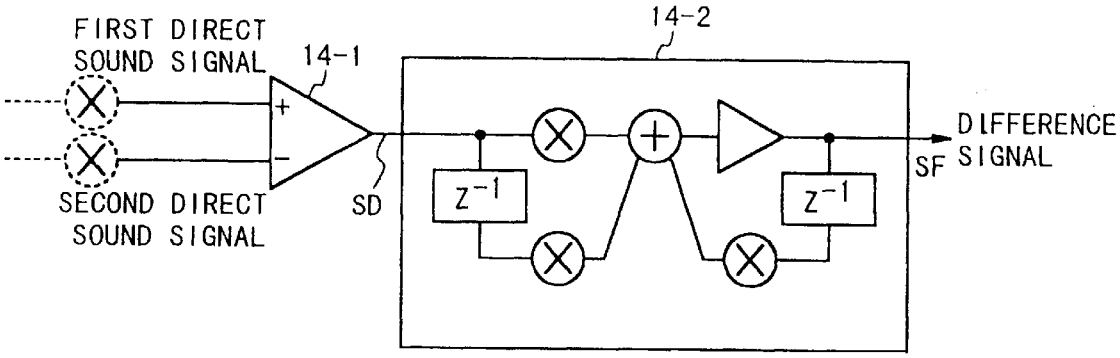
FIGS. 9 and 10 are block diagrams illustrating the structure of a control signal generating circuit of the virtual sound source positioning apparatus according to the second embodiment of the present invention.
Figure 10:
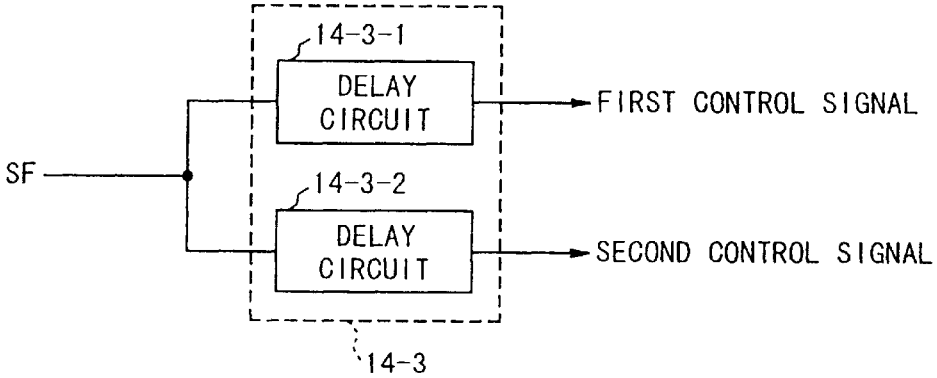

FIGS. 9 and 10 are block diagrams illustrating the structure of the control signal generating circuit 14 of the control section 12 in the third embodiment. The control signal generating circuit 14 is composed of the first calculating circuit 14-1, the filter circuit 14-2 and a delay section 14-3. The delay section 14-3 is composed of the delay circuit 14-3-1 for first generating circuit 16 and the delay circuit 14-3-2 for second generating circuit 18.

The first calculating circuit 14-1 subtracts the second direct sound signal supplied from the second signal processing circuit 11-2 from the first direct sound signal supplied from the first signal processing circuit 11-1. The output of the first calculating circuit 14-1, i.e., the difference signal SD is supplied to the filter circuit 14-2. As the filter circuit 14-2, the first-order low pass filter having the cutoff frequency of 600 Hz can be used. The output of the filter circuit 14-2 is supplied to the delay section 14-3 as the filtered difference signal SF. The delay circuit 14-3-1 of the delay section 14-3, delays the filtered difference signal SF by the time period determined in accordance with a delay coefficient. The output of the delay circuit 14-3-1 is supplied to the first generating circuit 16 as the first control signal. Also, the delay circuit 14-3-2 of the delay section 14-3, delays the filtered difference signal SF by a time period determined in accordance with a delay coefficient. The output of the delay circuit 14-3-2 is supplied to the second generating circuit 18 as the second control signal.

Figure 11:
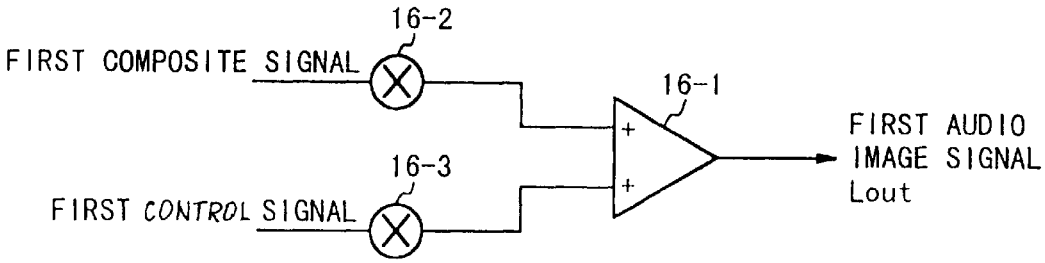
FIG. 11 is a block diagram illustrating the structure of a first generating circuit of the virtual sound source positioning apparatus according to the second embodiment of the present invention.

FIG. 11 is a block diagram illustrating the structure of the first generating circuit 16. The first generating circuit 16 is composed of a multiplier 16-2, a multiplier 16-3 and an adder 16-1. The multiplier 16-2 amplifies the first composite sound signal from the first signal processing circuit 11-1 as the first channel signal in accordance with a multiplication coefficient. The output of the multiplier 16-2 is supplied to one of the input terminals of the adder 16-1. The multiplier 16-3 amplifies the first control signal from the control signal generating circuit 14 in accordance with a multiplication coefficient. The output of the multiplier 16-3 is supplied to the other input terminal of the adder 16-1. The adder 16-1 adds the signal from the multiplier 16-2 and the signal from the multiplier 16-3. The output signal of the adder 16-1 is outputted as the first audio image signal, i.e., the left audio image signal.

Figure 12:
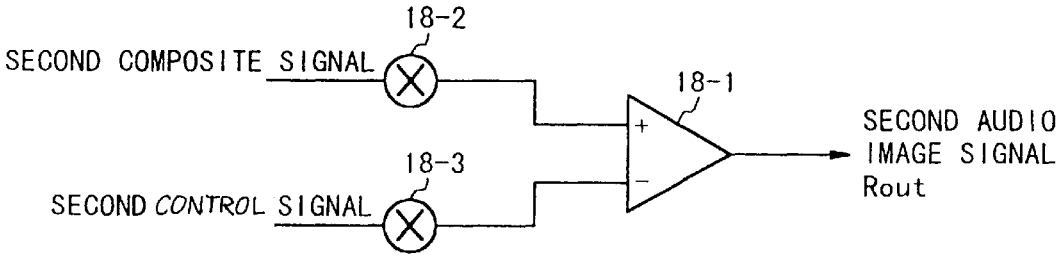
FIG. 12 is a block diagram illustrating the structure of a second generating circuit of the virtual sound source positioning apparatus according to the second embodiment of the present invention.

FIG. 12 is a block diagram illustrating the structure of the second generating circuit. The second generating circuit is composed of a multiplier 18-2, a multiplier 18-3 and a subtractor 18-1. The multiplier 18-2 amplifies the second composite sound signal from the second signal processing circuit 11-2 as the second channel signal in accordance with a multiplication coefficient. The output of the multiplier 18-2 is supplied to one of the input terminals of the subtractor 18-1. The multiplier 18-3 amplifies the second control signal from the control signal generating circuit 14 in accordance with a multiplication coefficient. The output of the multiplier 18-3 is supplied to the other input terminal of the subtractor 18-1. The subtractor 18-1 subtracts the signal supplied from the multiplier 18-3 from the signal supplied from the multiplier 18-2. The output signal of the subtractor 18-1 is outputted as the second audio image signal, i.e. the right audio image signal.

Figure 13:
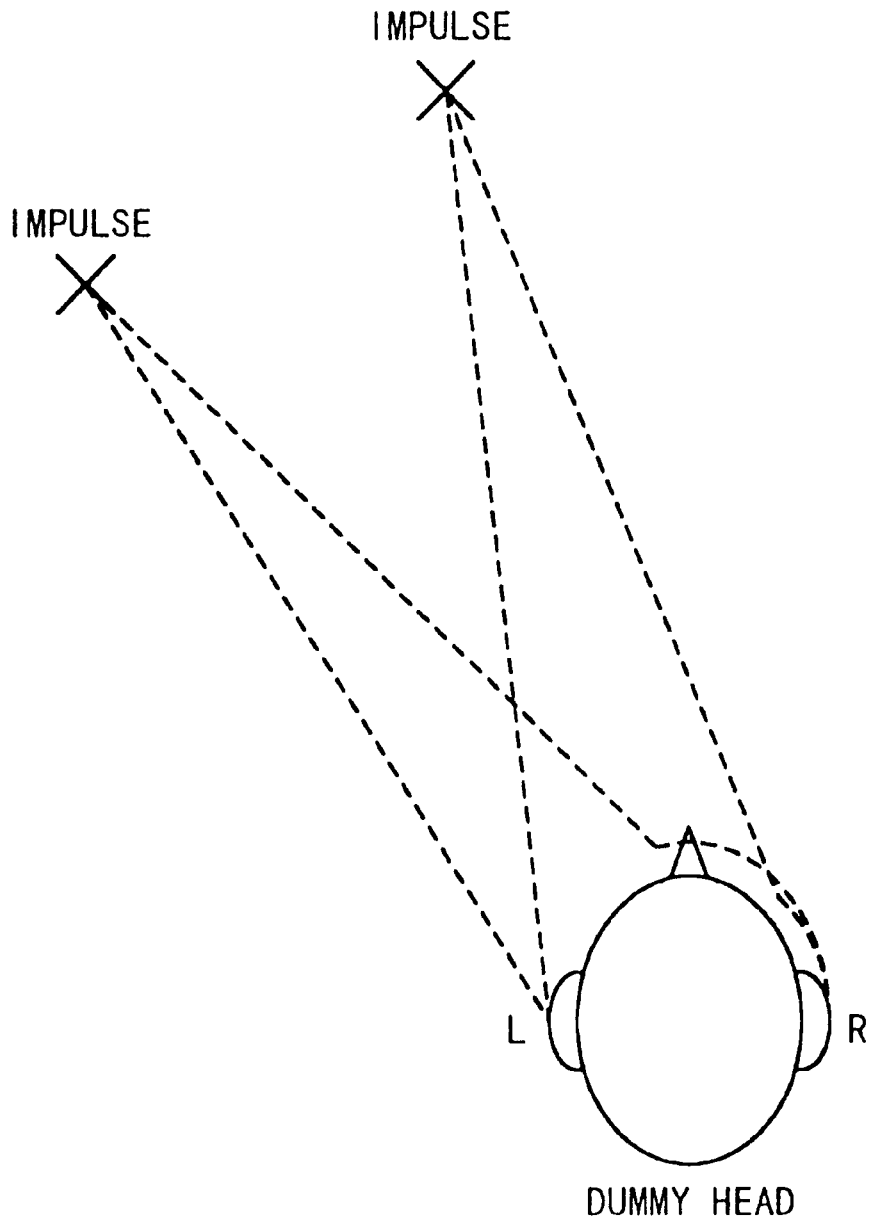
FIG. 13 is a diagram illustrating the state to measure a head acoustic transfer function using a dummy head microphone in the first embodiment of the present invention.

Next, the operation of the virtual sound source positioning apparatus of the second embodiment will be described. FIG. 13 shows a diagram illustrating the state to measure a head acoustic transfer function using a dummy head microphone. The measurement is preferably performed in the room where the reflection of some extent occurs. The impulse which is outputted from a speaker is collected by the dummy head microphone. In this case, the head acoustic transfer function is measured in the state in which impulses are generated from all the directions and distances with respect to the dummy head as a center.

Figures 14A, 14B:
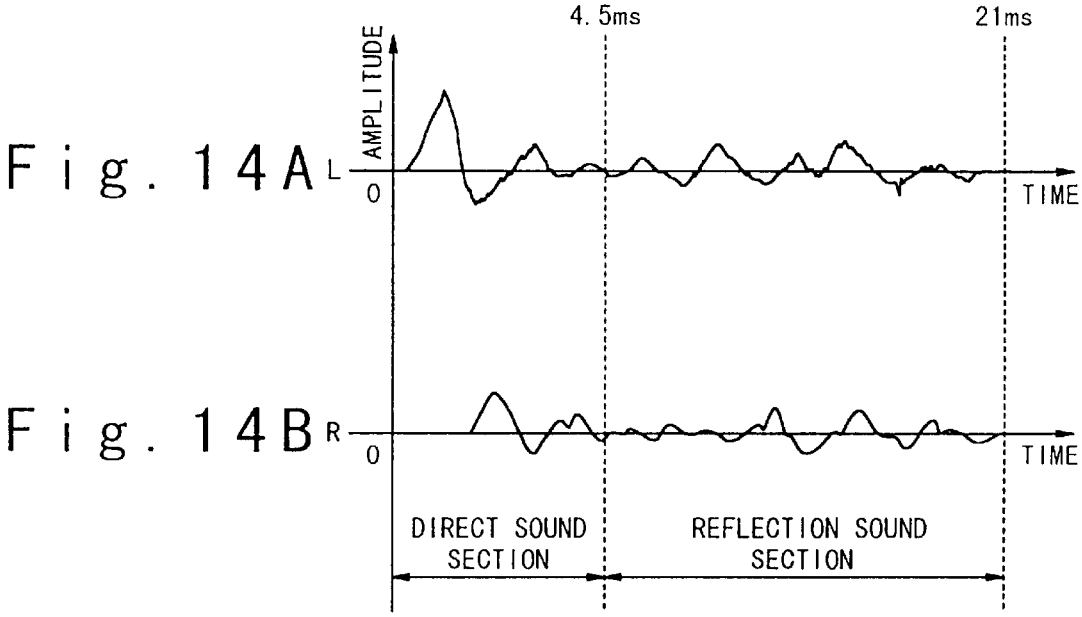
FIGS. 14A and 14B are diagrams illustrating an example of waveforms of the head acoustic transfer function which is measured using the dummy head microphone of FIG. 13.

FIGS. 14A and 14B show waveforms of an example of head impulse responses of the first and second head acoustic transfer functions measured in this way. In FIGS. 14A and 14B, the direct sound section is the head impulse response in a region of 4.5 ms after the impulse is inputted and the reflection sound section is the head impulse response in a region of 4.5 to 21 ms. These time values are based on the measurement and depend on the measurement environment.

Next, the method for producing an IIR-type filter equivalent to the head acoustic transfer function measured as described above will be described with reference to FIGS. 15A to 22B. First, the direct sound sections of the first and second head acoustic transfer functions are approximated by the eighth-order IIR-type filters 20 based on the direct sound sections of the waveforms (original waveforms) of the head impulse responses extracted as shown in FIGS. 15A and 15B. That is, various coefficients of the IIR-type filter 20 are determined. The waveforms of the approximated head impulse responses are shown in FIGS. 16A and 16B. The eighth-order IIR-type filter is ascertained through experiment that the approximation by the filter is the most effective from the point of the processing amount by the DSP. The filter is not limited to the eighth-order IIR-type filter and an optional filter may be used in accordance with the efficiency and the price required.

Next, in order to form the difference in time between both the ears when the first and second direct sounds reach both ears, predetermined delay coefficients are given to each of the delay circuits 22 and 26-1 to 26-7 of the signal processing circuit 11. In this manner, each delay circuit delays a corresponding signal supplied from the eighth-order IIR-type filter 20 in accordance with the delay coefficient to outputs the delayed signal. Through the above processing, the IIR-type filters 20 are constructed equivalent to the direct sound sections of the first and second head acoustic transfer functions as shown in FIGS. 17A and 17B.

Next, a circuit equivalent to the reflection section will be described. That is, a representative portion is extracted from each of the reflection sound sections of the waveforms (original waveforms) of the first and second head impulse responses collected as shown in FIGS. 18A and 18B. The first and second reflection sounds of the first and second head acoustic transfer functions are approximated by the sixth-order IIR-type filters 24 based on the waveforms of the extracted head impulse responses. The waveforms of the approximated head impulse response are shown in FIGS. 19A and 19B. The vertical scale which is different from other figures is used in FIGS. 19A and 19B and the expanded waveforms are illustrated. The sixth-order IIR-type filter is used because it has been shown through experimentation that this type of filter results in most efficient DSP processing. The filter is not limited to the sixth-order IIR-type filter and an optional filter may be used in accordance with the efficiency and the price required.

The seven amplitudes of the reflected wave are selected in a larger order from each of the reflection sound sections of the waveforms (the original waveforms) of the first and second head impulse responses, as shown in FIGS. 20A and 20B. The number of the amplitudes selected is not limited to seven. As shown in FIGS. 21A and 21B, waveforms of the head impulse responses approximated by the sixth-order IIR-type filter 24 using the selected seven amplitudes are multiplexed. Thus, a circuit equivalent to the reflection sound section is obtained. The waveform amplitudes are determined by multiplication coefficients which are given to the multiplier 21, 25-1 to 25-7. Also, the temporal positions of the selected amplitudes are adjusted by delay coefficients which are given to the delay circuits 26-1 to 26-7. The signals from the delay circuit 26-1 to 26-7 are added by the adder 23.

Finally, the head impulse response approximating the above direct sound section and the head impulse response approximating the reflection sound section are added by the adder 27 to represent characteristics equivalent to the head acoustic transfer function for each of the left and right channels, as shown in FIGS. 22A and 22B. In this manner, because the characteristics of the head acoustic transfer function are reflected to the first and second channel signals which are outputted from the signal processing circuit 11 of the virtual sound source positioning apparatus. If both of these signals are converted into acoustic signals by the headphone without passing through the control section 12, the listener hears the sound, because of the binaural effect, as from a virtual sound source positioned at a predetermined position outside the head of the listener.

Figure 23:
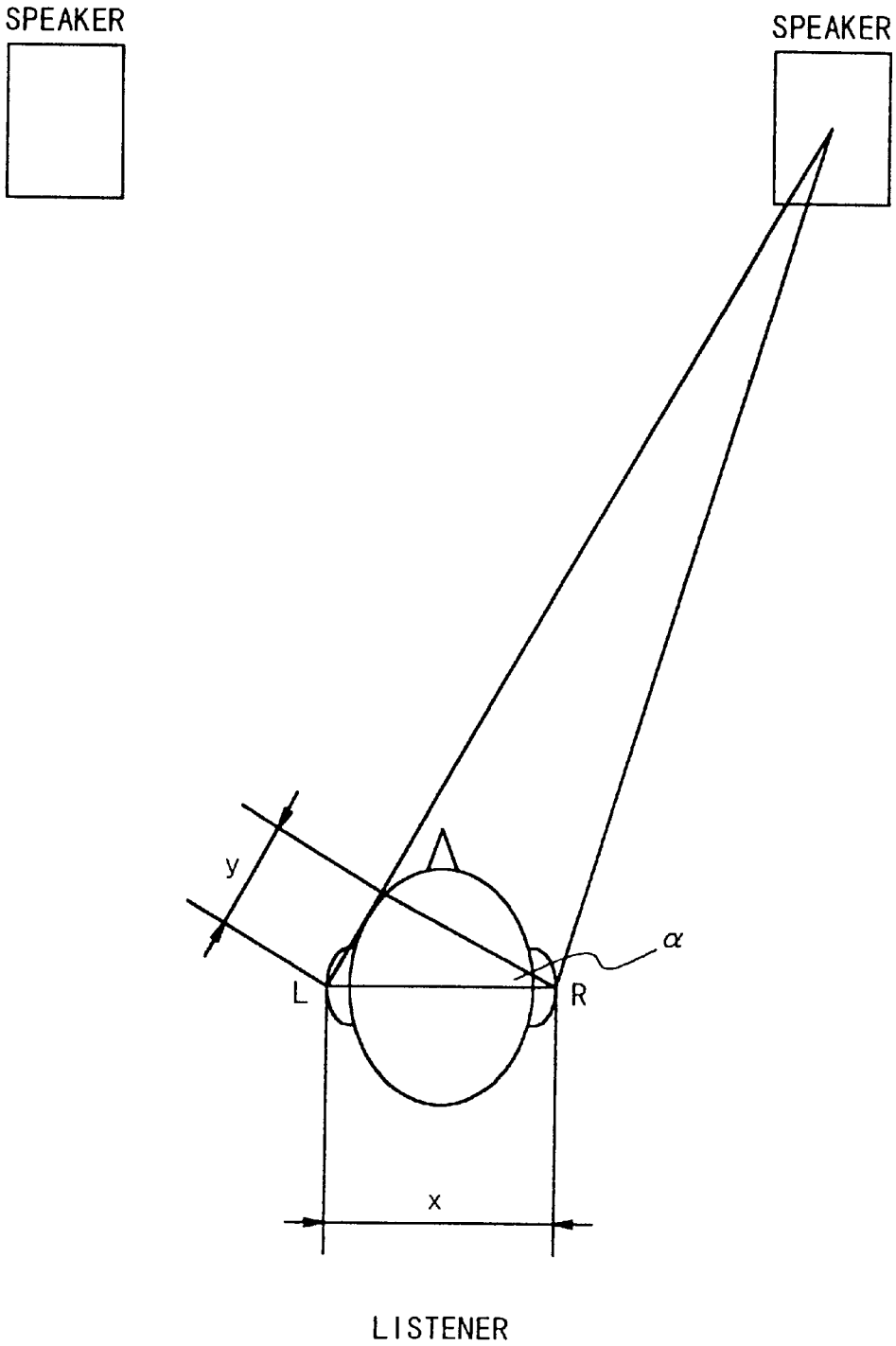
FIG. 23 is a diagram to explain the positioning and movement of the virtual sound source generated by the speakers in the second embodiment of the present invention.

Next, the positioning and movement of the virtual sound source when the sound is generated from speakers using the control section 12 of the virtual sound source positioning apparatus according to the second embodiment of the present invention will be described. As shown in FIG. 23, assuming that a diameter of the head of the listener is x and a speaker opening angle is $\alpha$, the path length difference between both ears of the listener are y is approximated by the following equation.

$$y \approx x \sin\alpha \quad (1)$$

where the speaker opening angle $\alpha$ is the angle between the front direction of the listener and the direction from the center of the head of the listener to one of the speakers. Now, supposing that the diameter of the head is 22 cm and the speaker opening angle is 15 degrees, the path length different is 5.69 cm. If the sonic velocity is 340 m/s, the reaching time difference in the path length difference of 5.69 cm corresponds to about 167 $\mu$s. If the sampling frequency is 48 kHz, the above time difference is equivalent to 8 sample points. Therefore, if the sounds outputted from the left and right speakers need to reach the right ear of the listener at the same time, it is sufficient to delay the sound outputted from the right speaker by 8 sample points. If the sounds are outputted from the left and right speakers with an inverse phase with respect to each other, and the sound outputted from the right speaker is delayed by 8 sample points, and the sounds cancels each other at the right ear. Therefore, audio image fields are formed such that the virtual sound source is positioned on the left side of the listener.

In this manner, if the virtual sound source is to be positioned on one lateral side of the listener, the signal reaching the ear on the other side of the listener is delayed by 8 sample points. If the virtual sound source is to be positioned on a position near to the front of the listener, the delay amount is decreased and if the virtual sound source is positioned on the front position of the listener, the delay amount is set to "0" Also, it is possible to smoothly move the virtual sound source by gradually changing the delay amount.

Figure 24A:
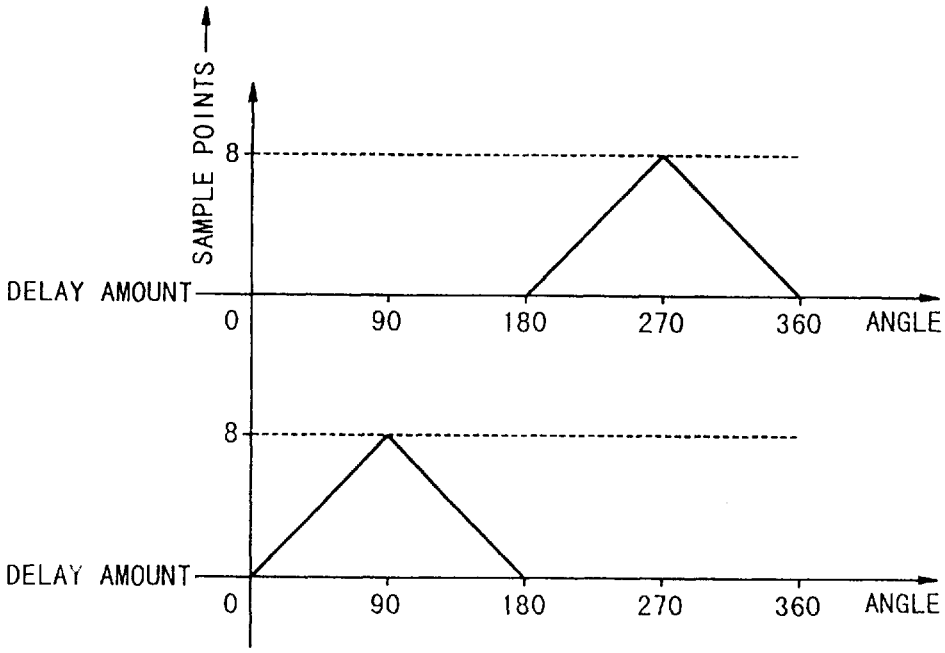
FIGS. 24A and 24B are diagrams illustrating the relation between the delay amount and the angle between a real sound source and the listener in the control signal generating section in the second embodiment of the present invention.
Figure 24B:
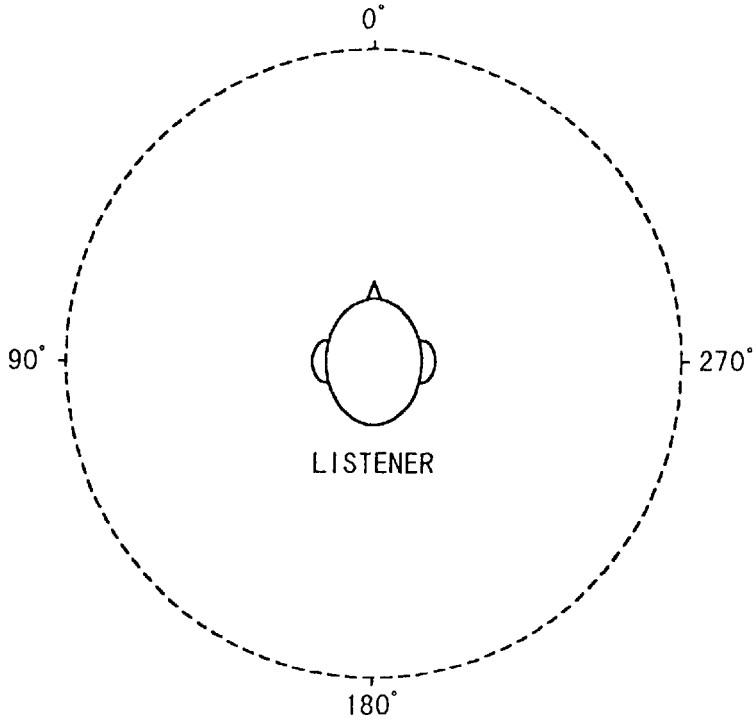

FIG. 24A shows the relation between the angle and the delay amount of the control signal generating circuit 14. As shown in FIG. 24B, supposing that a front direction is 0 degree, a left direction is 90 degrees, a rear direction is 180 degrees and a right direction is 270 degrees, the delay amount of each of the delay circuits 14-3-1 and 14-3-2 shown in FIG. 10 is as shown in FIG. 24A. For instance, if it is desired that the virtual sound source is positioned in the left direction (90 degrees), the delay amount of the delay circuit 14-3-1 for the left channel is set to "0" and the delay amount of the delay circuit 14-3-2 for the right channel is set to "8". As a result, the signals having inverse phases cancel each other around the right ear. The virtual sound source is positioned on the left side of the listener. In this case, if the signal with the characteristics of the first head acoustic transfer function for the left channel is added, the virtual sound source is clearly perceived to be positioned on the left side.

In the example shown in FIG. 24A, the delay amount to the virtual sound source position (the angle) of each channel is changed in a linear manner. However, the delay amount may be changed in a non-linear manner. For example, the delay amount may be changed in a trigonometric function, in an exponential function, or in various functions.

As described above, according to the second embodiment, the first channel signal is generated by adding the first composite sound signal and the first control signal which is generated based on the difference signal and the second channel signal is generated by adding the second control signal which is generated based on the difference signal, from the second composite sound signal. Therefore, the difference signal is outputted in a positive phase for the first channel and in a negative phase for the second channel. In this manner, because the point where the signals are cancelled appears on the acoustic space which is formed by both speakers, the virtual sound source can be positioned on a position other than the region between both speakers.

Further, because the first and second control signals which are outputted from the control signal generating circuit 14 are generated by delaying the difference signal, the point that the sound is cancelled can be moved from the left ear to the right ear on the sound space by changing the delay amount. For example, if the point where the sounds are cancelled is formed near the right ear on the sound space, the virtual sound source can be felt on the left side by the listener. Also, if the point that the sounds are cancelled is formed near the left ear on the sound space, the virtual sound source is perceived to be on the right by the listener. Further, if the point where the sounds are cancelled is formed in the center of the head on the sound space, the virtual sound source is perceived to be positioned in a front direction or in a rear direction. The position on the sound space of the point where the sounds are cancelled and the amount of the delay difference signal are controlled to satisfy the following relation. When the virtual sound source is positioned in either the left or right side of the listener, the amount of delay is set such that the point where the sounds cancel is formed in the neighborhood of the ear on the other side of the listener in the sound space. As the cancellation point approaches the front direction, the delay amount is made small and when the cancellation point is positioned in the front, the delay amount is set to "0". Thereby, the virtual sound source is clearly positioned, and further the sense of distance to the virtual sound source is obtained.

In the virtual sound source positioning apparatus according to the second embodiment, because the first and second control signals for controlling the formation of the sound space where sounds are cancelled, and the first and second composite sound signals which has the above-mentioned binaural effect are superimposed and outputted, the virtual sound source can be clearly positioned in an arbitrary direction.

Also, in the virtual sound source positioning apparatus according to the second embodiment, it is possible to compose the virtual sound source positioning apparatus such that whether or not the difference signal is outputted from the control signal generating circuit 14 can be selected. The structure is suitable for speaker listening when the difference signal is outputted and for headphone listening when the difference signal is not outputted.

Figure 25:
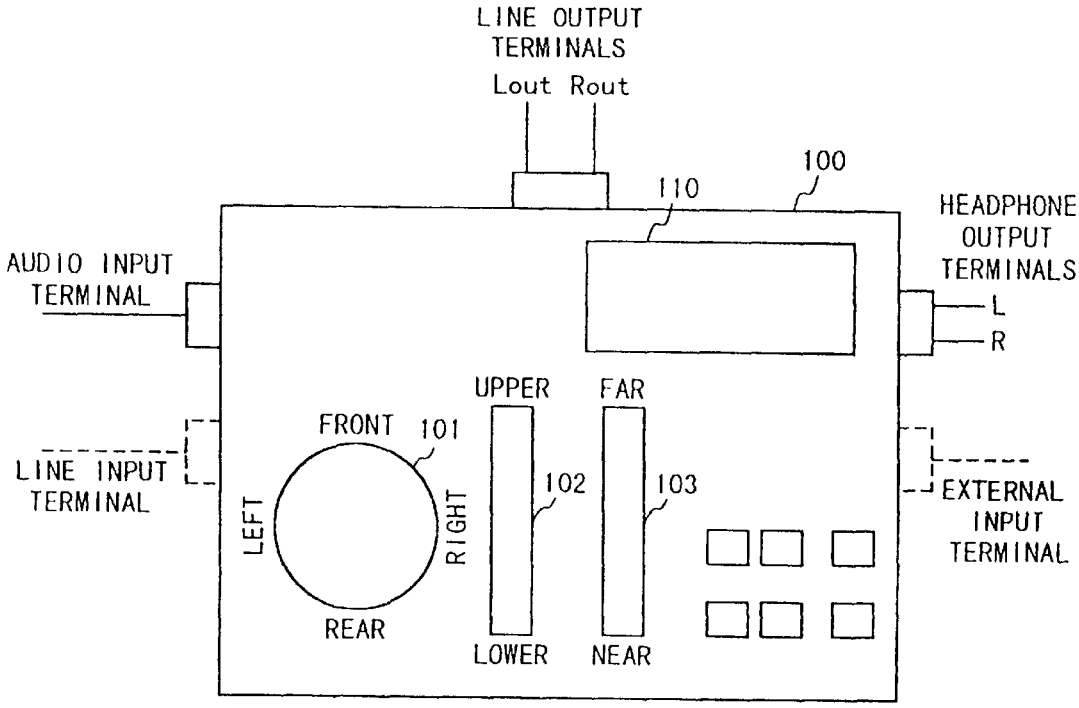
FIG. 25 is a diagram illustrating the outward appearance of the stereo virtual sound source positioning apparatus according to the second embodiment of the present invention.

FIG. 25 is a diagram when the virtual sound source positioning apparatus is viewed from the top. An operation panel 100 and a display unit 110 are provided on the top surface of the virtual sound source positioning apparatus. Various switches such as an angle specifying switch 101, an upper-and-lower position specifying switch 102, and a near-and-far specifying switch 103 are provided on the operation panel 100. For example, the angle control 101 is used to specify the position of the virtual sound source when an angle of the front of the listener is 0 degree. For example, as the angle specifying switch 101, a rotary encoder or an operation element equivalent to it can be used. Also, a joystick can be used instead of the angle specifying switch 101. The upper-and-lower specifying switch 102 is used to specify the position of the virtual sound source in the upper or lower direction. As the upper-and-lower specifying switch 102, a slide volume, a rotary volume or an operation element equivalent to them can be used. Also, the near-and-far specifying switch 103 is used to specify the distance from the listener to the virtual sound source. As the near-and-far specifying switch 103, a slide volume, a rotary volume or an operation element equivalent to them can be used. The virtual sound source can be specified by the above three switches 101 to 103 in all the positions on the sound space. Also, the display unit 110 is provided on the top surface of the virtual sound source positioning apparatus. Information on the currently specified position of the virtual sound source such as the angle, the upper or lower position and the distance and so on is displayed in the numerical value or the picture on the display unit 110. Also, an audio input terminal is provided to the virtual sound source positioning apparatus. The audio input signal is inputted into the virtual sound source positioning apparatus through the audio input terminal. Also, as the output terminals, the headphone output terminals and the line output terminals are provided. The left channel signal Lout as the first audio image signal and the right channel signal Rout as the second audio image signal are outputted from these terminals. Thereby, headphone listening and speaker listening is made possible. Also, an external input terminal is provided to the virtual sound source positioning apparatus and the position information on the virtual sound source can be inputted from an external equipment such as a MIDI equipment, a computer and so on. Moreover, a line input terminal is provided and the signal that the virtual sound source position is controlled can be superposed on the audio signal of a given music from an external stereo system and the superposed signal can be outputted.

Figure 26:
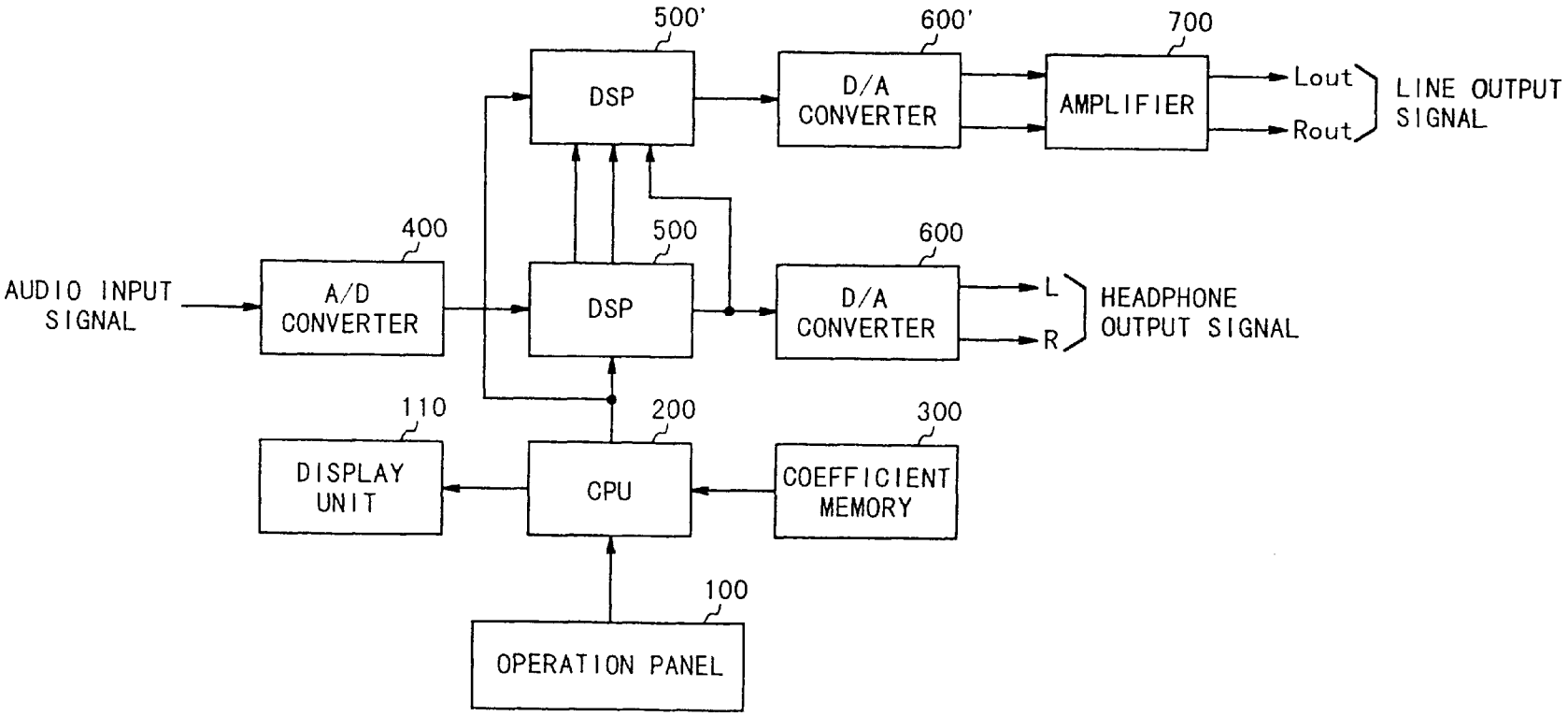
FIG. 26 is a block diagram illustrating an example of physical structure of the stereo virtual sound source positioning apparatus according to the second of the present invention.

FIG. 26 is a block diagram illustrating the circuit structure of the virtual sound source positioning apparatus. An audio input signal externally inputted is converted into digital data by an A/D converter 400 and is sent to a DSP 500 which performs the processing corresponding to that of the channel signal generating section 10. The DSP 500 processes the received digital data in accordance with the coefficients which are sent from the CPU 200 and generates digital channel signals as mentioned above. The channel signals generated by the DSP 500 are sent to a D/A converter 600. The D/A converter 600 converts the received digital channel signals into analog channel signals. The analog channel signals from the D/A converter 600 are outputted from the headphone output terminals as the headphone output signals. Also, the digital channel signals from the DSP 500 is supplied to a DSP 500'. The DSP 500', which performing the processing corresponding to that of the control section 12, processes the received digital channel signals in accordance with the coefficients which are sent from the CPU 200 and generates digital audio image signals as mentioned above. The audio image signals generated by the DSP 500' are sent to a D/A converter 600'. The D/A converter 600' converts the received digital audio image signals into analog audio image signals. The analog audio image signals from the D/A converter 600' are amplified by an amplifier 700 and outputted from the line output terminals as the speaker output signals.

On the other hand, the coefficients (filter coefficients, multiplication coefficients, delay coefficients and so on) which correspond to a plurality of virtual sound source positions are stored in a coefficient memory 300. For example, the coefficient memory 300 can be composed of a ROM. Also, the position information indicative of the virtual sound source position specified by the switch 101 to 103 on the operation panel 100 is converted into the digital data and is sent to the CPU 200. The CPU 200 reads the coefficients corresponding to this digital data from the coefficient memory 300 and sends them to the DSP 500 and the DSP 500'. Thereby, the DSP 500 and the DSP 500' generate the channel signals and the audio image signals from the audio input signal through the above-mentioned operation. When one of the switches 101 to 103 on the operation panel 100 is operated during sound generation, the processing for gradually moving the virtual sound source position is performed by panning the virtual sound source position between a newly specified position and a currently specified position.

Figure 27:
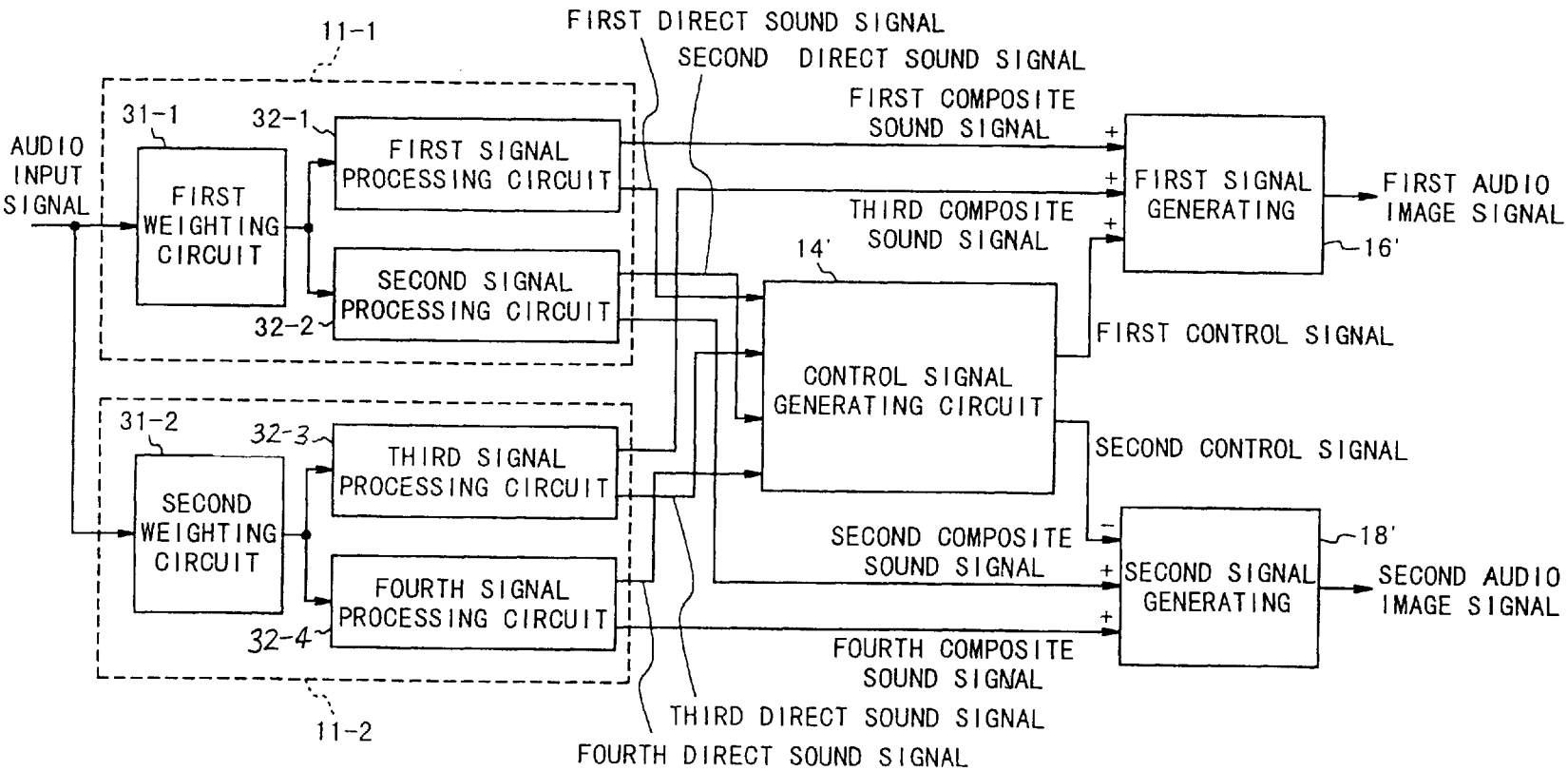
FIG. 27 is a block diagram illustrating the structure of the virtual sound source positioning apparatus according to a third embodiment of the present invention.

Next, the virtual sound source positioning apparatus according to the third embodiment of the present invention will be described with reference to FIG. 27. FIG. 27 is a block diagram illustrating the structure of the virtual sound source positioning apparatus according to the third embodiment of the present invention. Referring to FIG. 27, the channel signal generating sections 11-1 and 11-2 of the virtual sound source positioning apparatus in the third embodiment is composed of first and second weighting circuits 31-1 and 31-2 and first to fourth signal processing circuit 32-1 to 32-4, each of which has the function equivalent to the signal processing circuit 11 of the virtual sound source positioning apparatus in the above mentioned second embodiment. The first weighting circuit 31-1 is provided to the first and second signal processing circuit 32-1 and 32-2 and the second weighting circuit 31-2 is provided to the third and fourth signal processing circuit 32-3 and 32-4. Therefore, the one audio image is positioned by the first system of function blocks for the first and second signal processing circuits 32-1 and 32-2 and the other audio image is positioned in the second system of function blocks for the third and fourth signal processing circuits 32-3 and 32-4. The first weighting circuit 31-1, the second weighting circuit 31-2, the first to fourth signal processing circuits 32-1 to 32-4, the control signal generating circuit 14, the first generating circuit 16', and the second generating circuit 18' shown in FIG. 27 are realized by a DSP.

In the third embodiment, the first channel signal is the left channel signal and the second channel signal is the right channel signal. Therefore, the first composite sound signal and the first direct sound signal which are generated by the first signal processing circuit 32-1 are the left composite sound signal and the left direct sound signal, respectively. The third composite sound signal and the third direct sound signal which are generated by the third signal processing circuit 32-3 are also the left composite sound signal and the left direct sound signal, respectively. Similarly, the second composite sound signal and the second direct sound signal which are generated by the second signal processing circuit 32-2 are the right composite sound signal and the right direct sound signal, respectively. The fourth composite sound signal and the fourth direct sound signal which are generated by the fourth signal processing circuit 32-4 are the right composite sound signal and the right direct sound signal, respectively.

Also, the first control signal which is generated by the control signal generating circuit 14 is the left control signal and the second control signal is the right control signal. The first weighting circuit 31-1 and the second weighting circuit 31-2 which are shown in FIG. 27 can be composed of the first and second multipliers, respectively. It is assumed that the multiplication coefficient allocated to the first multiplier is K1, the multiplication coefficient allocated to the second multiplier is K2. Each of the multiplication coefficients K1 and K2 is supposed to be able to take a value in a range of "0" to "1". These multiplication coefficients K1 and K2 are determined to satisfy the following equation and given to the first and second multipliers described above.

$$K1+K2=1 \tag{2}$$

Therefore, the virtual sound source positioning apparatus is operated only by the first system of function blocks, when the multiplication coefficients K1=1 and K2=0 are given. On the contrary, the virtual sound source positioning apparatus is operated only by the second system of function blocks, when the multiplication coefficients K1=0, K2=1 are given. When both the first and second systems of function blocks are operated at the same time, the multiplication coefficients in a range of "0<K1 and K2<1" are given. The signal which is weighted by the first multiplier is supplied to the first and second signal processing circuits 32-1 and 32-2, and the signal which is weighted by the second multiplier is supplied to the third and fourth signal processing circuits 32-3 and 32-4. The structure of each of the first to fourth signal processing circuits 32-1 to 32-4 is the same as the second signal processing circuit 11 in the second embodiment and it is already described with reference to the block diagram of FIG. 5. However, the coefficients which are given to each of the elements (the filter, the multiplier, and the delay circuit) which each of their circuits is composed of are different between the circuit 11 and each of the circuits 32-1 to 32-4. That is, the coefficients for approximating the first head acoustic transfer function are given to the first and third signal processing circuits 32-1 and 32-3. The coefficients or approximating the second head acoustic transfer function s given to the second and fourth processing circuits 32-2 and 32-4.

Figure 28:
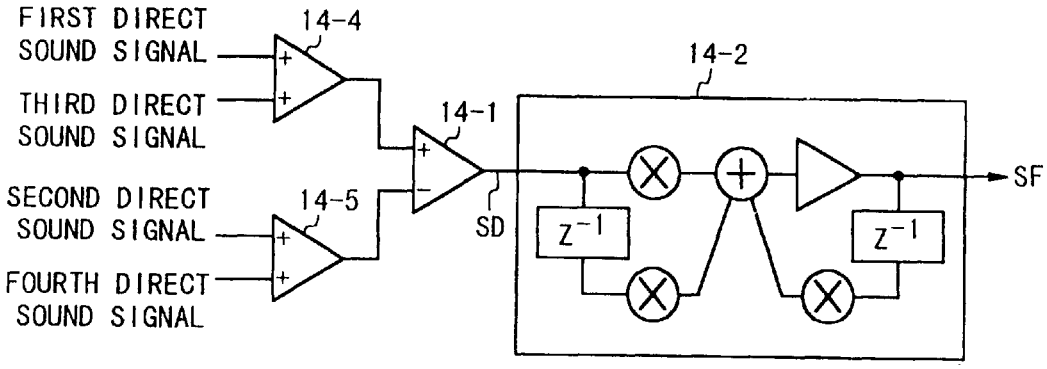
FIG. 28 is a block diagram illustrating the structure of the control signal generating section according to third embodiment of the present invention.

FIG. 28 is a block diagram illustrating the structure of the control signal generating circuit 14. The control signal generating circuit 14 is composed of an adder 14-4, an adder 14-5, a subtractor 14-1, a filter 14-2, and a delay circuit identical to FIG. 10, 14-3. The adder 14-4 adds the first direct sound signal from the first signal processing circuit 32-1 and the third direct sound signal from the third signal processing circuit 32-3. The output of the adder 14-4 is supplied to one of the input terminals of the subtractor 14-1. The adder 14-5 adds the second direct sound signal from the second signal processing circuit 32-2 and the fourth direct sound signal from the fourth signal processing circuit 32-4. The output of the adder 14-5 is supplied to the other input terminal of the subtractor 14-1. The subtractor 14-1 subtracts the output signal of the adder 14-5 from the output signal of the adder 14-4 to produce a difference signal SD. The output of the subtractor 14-1 is supplied to the filter 14-2. As the filter 14-2, the same filter as in the above second embodiment can be used. The output of the filter 14-2 is supplied to the delay circuit as the filtered difference signal SF. As the delay circuit, the same delay circuit 14-3 as described in the second embodiment can be used. The detail of the delay circuit was already described with reference to FIG. 10.

Figure 29:
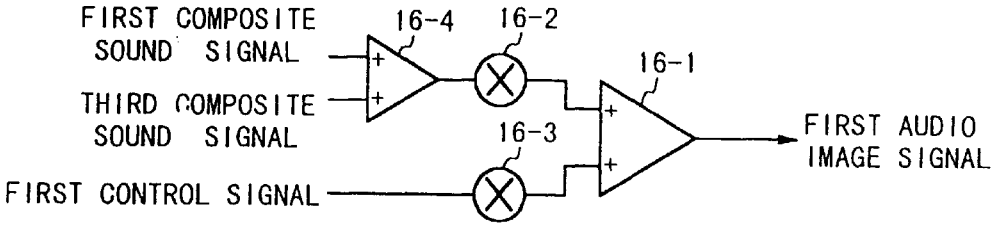
FIG. 29 is a block diagram illustrating the structure of the first generating circuit of the virtual sound source positioning apparatus according to the third embodiment of the present invention.

The first control signal from the delay circuit 14-3 is supplied to the first generating circuit 16' and the second control signal is supplied to the second generating circuit 18'. The first generating circuit 16' is composed of an adder 16-4, a multiplier 16-2, a multiplier 16-3 and an adder 16-1, as shown in FIG. 29. The adder 16-4 adds the first composite sound signal from the first signal processing circuit 32-1 and the third composite sound signal from the third signal processing circuit 32-3. The output of the adder 16-4 is supplied to the multiplier 16-2. The multiplier 16-2 amplifies the signal from the adder 16-4 in accordance with a multiplication coefficient given previously. The output of the multiplier 16-2 is supplied to one of the input terminals of the adder 16-1. The multiplier 16-3 amplifies the first control signal from the control signal generating circuit 14 in accordance with a multiplication coefficient given previously. The output of the multiplier 16-3 is supplied to the other input terminal of the adder 16-1. The adder 16-1 adds the signal from the multiplier 16-2 and the signal from the multiplier 16-3. The signal of the adder 16-1 is outputted as the first audio image signal, i.e., the left channel signal.

Figure 30:
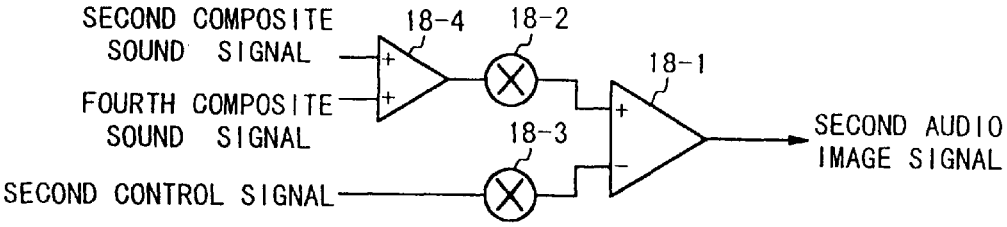
FIG. 30 is a block diagram illustrating the structure of the second generating circuit of the virtual sound source positioning apparatus according to the third embodiment of the present invention.

The second generating circuit 18' is composed of an adder 18-4, a multiplier 18-2, a multiplier 18-3 and a subtractor 18-1, as shown in FIG. 30. The adder 18-4 adds the second composite sound signal from the second signal processing circuit 32-2 and the fourth composite sound signal from the fourth signal processing circuit 32-4. The output of the adder 18-4 is supplied to the multiplier 18-2. The multiplier 18-2 amplifies the signal from the adder 18-4 in accordance with a multiplication coefficient given previously. The output of the multiplier 18-2 is supplied to the of the input terminals of the subtractor 18-1. The multiplier 18-3 amplifies the second control signal from the control signal generating circuit 14 in accordance with a multiplication coefficient given previously. The output of the multiplier 18-3 is supplied to the other input terminal of the subtractor 18-1. The subtractor 18-1 subtracts the signal supplied from the multiplier 18-3 from the signal supplied from the multiplier 18-2. The signal of the subtractor 18-1 is output as the second sound image signal, i.e., the left channel signal.

Next, the operation of the virtual sound source positioning apparatus of the third embodiment will be described.

The virtual sound source positioning apparatus in the third embodiment includes the 2 systems of function blocks, the operation of each of the 2 systems of function blocks is same as that of the virtual sound source positioning apparatus in the above-mentioned second embodiment. According to the virtual sound source positioning apparatus in the third embodiment, the one virtual sound source can be positioned by the first system of function blocks and the other virtual sound source can be positioned by the second system of function blocks.

Now, assuming that the multiplication coefficient K1 which is allocated to the first multiplier 31-1 which composes the first weighting circuit 31-1 is "1", and the multiplication coefficient which is allocated to the second multiplier which composes the second weighting circuit 31-2 is "0", the audio signal positioning apparatus in the third embodiment is equal to the state in which the second system of function blocks is not present. Therefore, similarly in the virtual sound source positioning apparatus in the above-mentioned second embodiment, only one virtual sound source is positioned by the first system of function blocks. If the multiplication coefficient K1 is made gradually smaller from this state and the multiplication coefficient K2 is made gradually larger, the sound from the virtual sound source positioned by the first system of function blocks gradually becomes weak, and the sound from the virtual sound source positioned by the second system of function blocks gradually becomes large. When the multiplication coefficient K1 given the first multiplier is set to "0" and the multiplication coefficient K2 given to the second multiplier is set to "1", the virtual sound source positioning apparatus in the third embodiment is equivalent to the state in which the first system of function blocks is not present. Therefore, like the virtual sound source positioning apparatus in the above-mentioned second embodiment, only one virtual sound source is positioned by the second system of function block. Therefore, when the virtual sound source is moved from one position to another position, the multiplication coefficient K1 of the first multiplier is gradually increased and the multiplication coefficient K2 of the second multiplier is gradually decreased or the multiplication coefficient K1 of the first multiplier is gradually decreased and the multiplication coefficient K2 of the second multiplier is gradually increased. Thus, the generation of the noise with which replacement of the coefficients for the virtual sound source positioning apparatus is accompanied is suppressed and the virtual sound source can be smoothly moved.

Also, because the generation of the noise can be suppressed even if the virtual sound source is moved to a large extent, it is unnecessary to prepare many coefficients which correspond to a lot of positions of the virtual sound source unlike the conventional virtual sound source positioning apparatus. That is, it is possible to make the number of coefficients which need to be prepared in advance small.

More particularly, the multiplication coefficient K1 which is given to the first multiplier composing the first weighting circuit 31-1 and the multiplication coefficient K2 which is given to the second multiplier composing the second weighting circuit 31-2 are gradually changed as mentioned above such that the virtual sound source position is moved. Thus, the generation of noise due to movement of the virtual sound source position to a very large extent (due to large change in the multiplication coefficients) can be restrained. When the virtual sound source is moved, if the position of the virtual sound source is not moved greatly, in other words, if the multiplication coefficients are not hanged greatly, noise is not generated.

Therefore, if the number of the possible positions of the virtual sound source (the number of the multiplication coefficients stored in the coefficient memory 300) is increased, and if the virtual sound source is moved via the middle positions on the way when the virtual sound source is moved from the current position to a new position, the panning process as described above becomes unnecessary. In this case, it is not necessary to provide the 2 system of function blocks unlike the third embodiment. The virtual sound source positioning apparatus in the above-mentioned second embodiment can be used.

According to this structure, the processing quantity of the DSP 500 can be decreased to a half. As described above in detail, according to the virtual sound source positioning apparatus in the second and third embodiments, the virtual sound source can be positioned on an arbitrary position of the positions which contain the position far from the listener by the 2-channel speaker reproduction and the sense that the virtual sound source is positioned out of the head of the listener is obtained even if the sound is heard through the headphone.

Next, the virtual sound source positioning apparatus in the fourth embodiment of the present invention will be described.

In above-mentioned Japanese Laid Open Patent Disclosure (JP-A-Heisei 4-56600), the virtual sound source is positioned by supplying predetermined coefficients to each of the delay circuits, the amplifiers and the filters such as the FIR filter. However, there is a problem that noise has been generated when the filter coefficients are changed during he signal processing to change the filtering characteristic. The virtual sound source positioning apparatus according to the fourth embodiment of the present invention can position the virtual sound source outside of the headphone listener's head and position the virtual sound source at an arbitrary position to a speaker listener, and further can smoothly move the virtual sound source while suppressing the generation of noise.

Figure 33A:
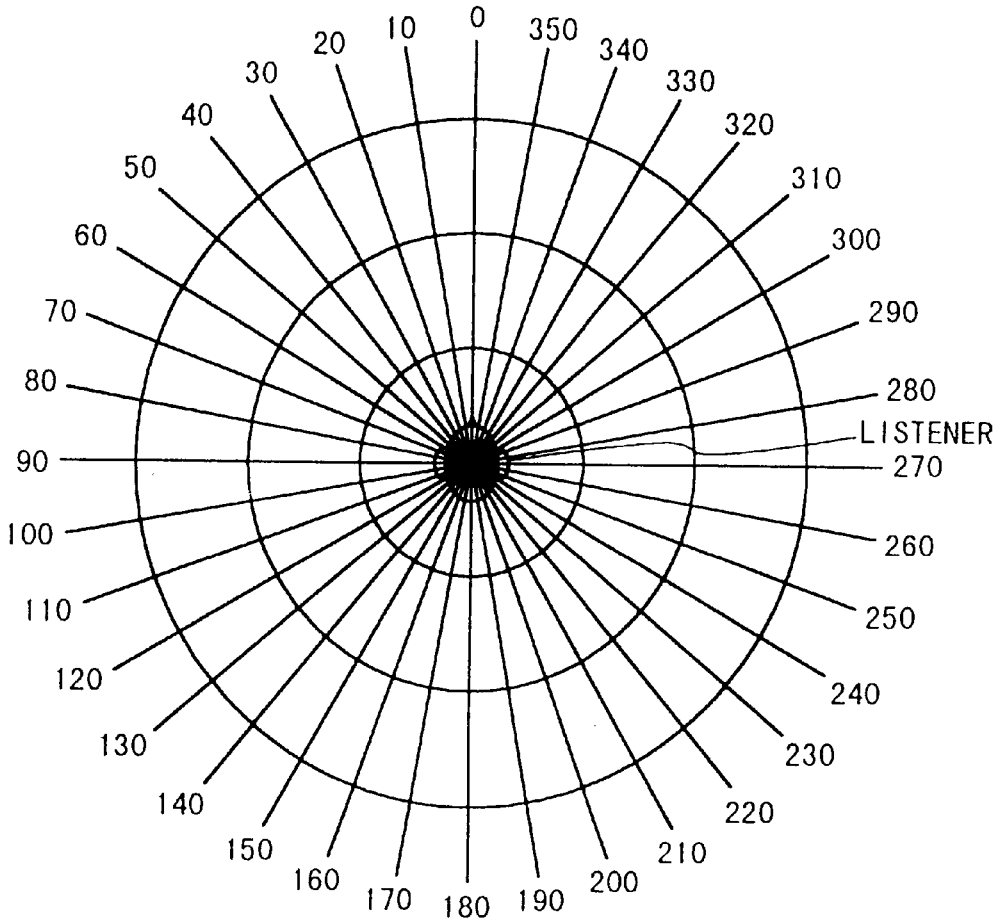
FIGS. 33A and 33B are diagrams to explain the operation of the virtual sound source positioning apparatus according to the fourth embodiment of the present invention.
Figure 33B:
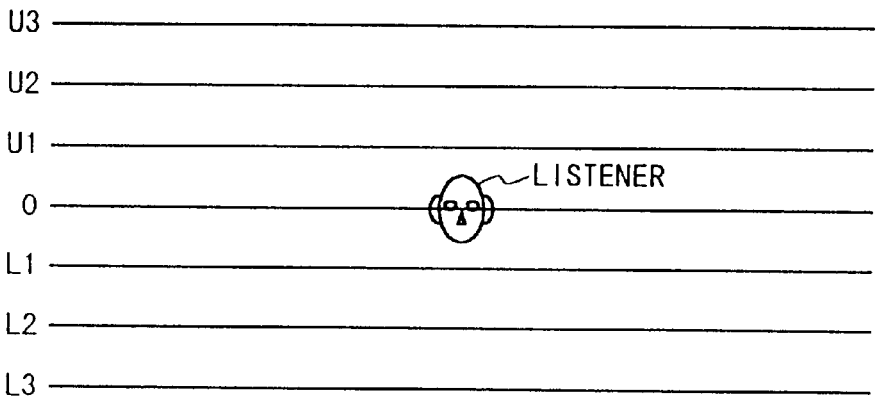

Next, the virtual sound source positioning apparatus according to the fourth embodiment of the present invention will be described below in detail. In the following description, the virtual sound source positioning apparatus generates the first audio image signal for the left ear and the second audio image signal for the right ear from one audio input signal. In the fourth embodiment, the coefficient memory circuit 300 is supposed to be composed of a ROM. Coefficient groups for the virtual sound source positions for every 10 degrees from 0 degree to 360 degrees on a concentric circle when a listener is positioned on a center are stored in the ROM 300, as shown in for example, FIG. 33A. Here, each of the intersections of the concentric circle and lines in a radial direction is the position of the virtual sound source. Further, as shown in FIG. 33B, the above virtual sound source positions are provided in an upper and lower direction as indicated by U3 to U1, 0, L1 to L3 around the listener. In the following description, the case where the virtual sound source is moved on one concentric circle on one plane will be described for simplification of the description. Also, in the fourth embodiment, the joystick 101 on the operation panel 100 is supposed to be used as the instructing circuit 100.

In the joystick 101, a rotating angle in rotary encoder which is connected to an operation section (a movable section) is converted into a digital signal by an A/D converter and is output. The digital signal is the signal which indicates the position of the virtual sound source in angle of 0 degree to 360 degrees. The coefficient read circuit 200 can be composed of, for example, the CPU 200. The CPU 200 receives the digital signal which indicates the virtual sound source position from the joystick 101 and reads the coefficients from the coefficient memory circuit 300 in accordance with the digital signal. The read coefficients include the filter coefficients, the delay coefficients and the amplification coefficients used to position the virtual sound source on a position which is instructed by the joystick 101. The CPU 200 supplies the coefficients to the delay circuit, the weighting circuit, the signal processing circuit.

Figure 32:
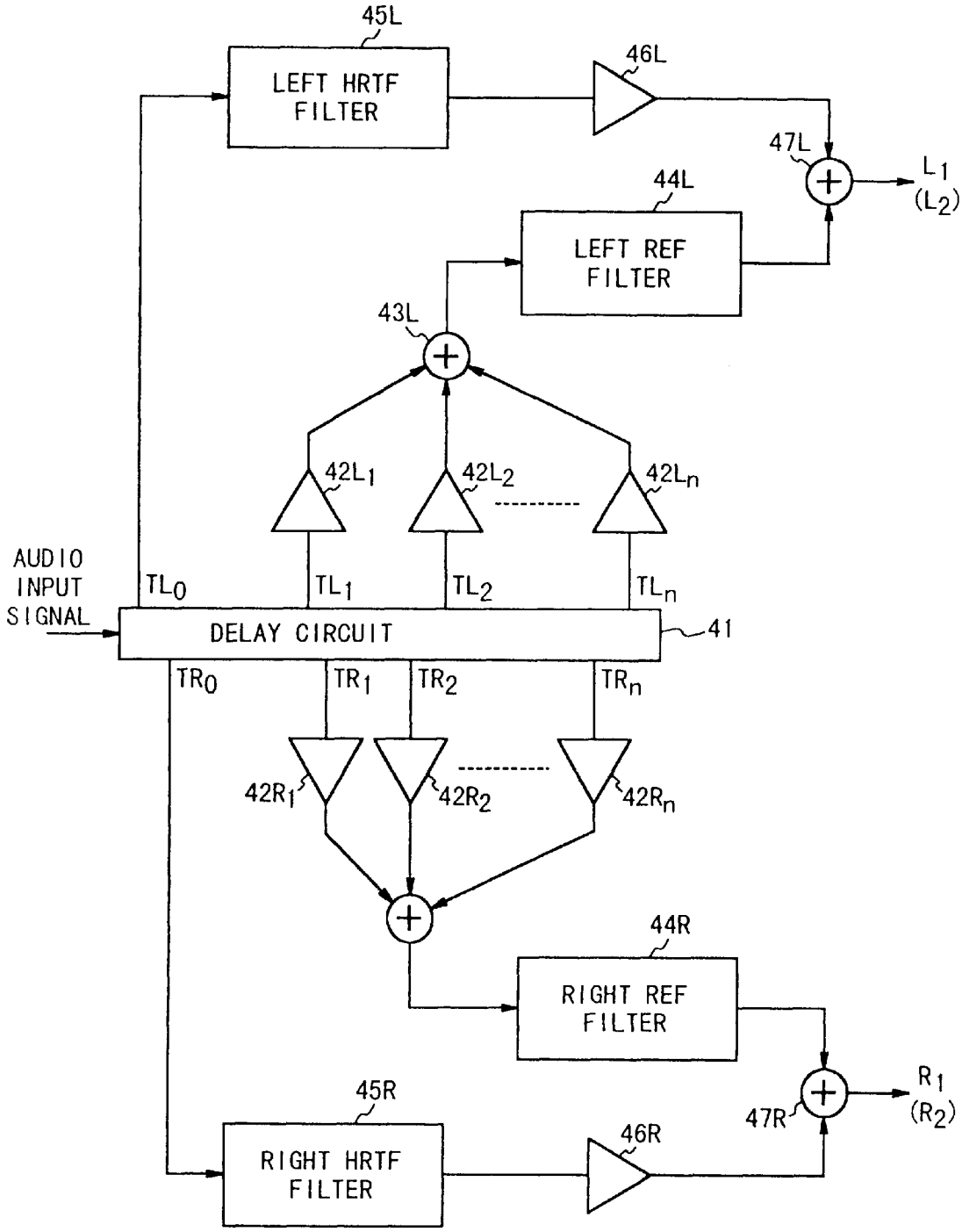
FIG. 32 is a block diagram illustrating the detailed structure of the virtual sound source positioning apparatus according to the fourth embodiment of the present invention.

FIG. 32 is a block diagram illustrating the structure of the channel signal generating section 10 according to the fourth embodiment of the virtual sound source positioning apparatus. The channel signal generating section 10 is divided into the first circuit section for generating the first channel signal L1 and the second circuit section for generating the second channel signal R1. Because the structures of the first and second circuit sections are the same, only the first circuit section will be described below.

Figure 31:
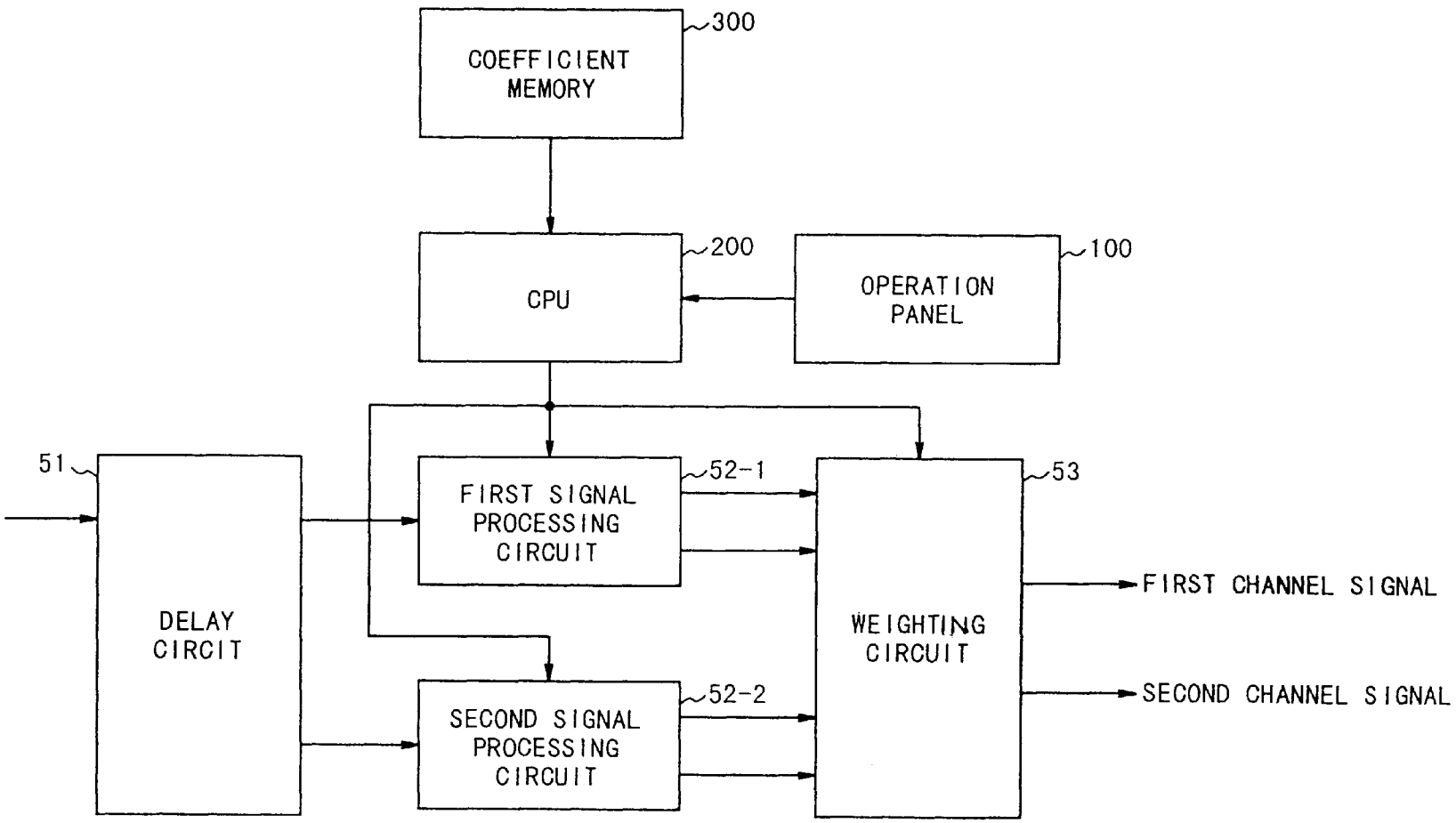
FIG. 31 is a block diagram which shows the structure of the virtual sound source positioning apparatus according to a fourth embodiment of the present invention.

The channel signal generating section 10 is composed of a delay section 51, a first signal processing circuit 52-1, a second signal processing circuit 52-2, and a weighting circuit 53, as shown in FIG. 31. In the channel signal generating section 10, a delay circuit 41 as the delay section 51 (51-1 and 51-2) has a plurality of output portions TL0 to TLn and TR0 to TRn which output signals are obtained by delaying an audio input signal by predetermined delay times. As the delay circuit 41, well-known delay circuits can be used which are composed as a predetermined delay time is obtained using a RAM (not illustrated). The delay circuit 41 outputs the delay signal obtained by delaying the audio input signal by a first predetermined time, from the output portion TL0. That is, the CPU 200 reads the delay coefficients corresponding to the position which is instructed by the joystick 101, from the coefficient memory circuit 300 and supplies to the delay circuit 41. Thereby, the delay signal having the first predetermined delay time is outputted from the output portion TL0 of the delay circuit 41. The time difference when a sound reaches from a speaker to left and right ears is represented by the delay time of the delay signal from the output portion TL0 and the delay time of a corresponding delay signal from the output section TR0 of the delay circuit 41. The output from the output section TL0 of the delay circuit 41 is supplied to a left HRTF filter 45L.

The left HRTF filter 45L is the filter by which the first head acoustic transfer function is approximated. The left HRTF filter 45L can be composed of a j-th IIR-type filter ($0<j\leqq 10$, for example j=8). The CPU 200 reads the filter coefficients corresponding to the position which is instructed by the joystick 101, from the coefficient memory circuit 300 and supplies to the left HRTF filter 45L. The delay signal from the output portion TL0 of the delay circuit 41 is filtered in accordance with the filter coefficients by the left HRTF filter 45L and supplied to the amplifier 46L.

The amplifier 46L amplifies the inputted signal. For example, the amplifier 46L can be composed using a multiplier. The CPU 200 reads the amplification coefficient corresponding to the position which is instructed by the joystick 101, from the coefficient memory circuit 300 and supplies to the amplifier 46L. Thereby, the amplitude of the response to the first head acoustic transfer function is reproduced. The output of the amplifier 46L is supplied to Ln adder 47L. The audio input signal is processed as the delay circuit 41→ the left HRTF filter 45L→ the amplifier 46L in this order in this example. However, the order is not limited and may be optional. For example, the audio input signal may be processed in order of the delay circuit 41→ the amplifier 46L→ the left HRTF filter 45L.

The n delay signals from the output portions (taps) TL1 to TLn of the delay circuit 41 are amplified by n amplification circuits 42L1 to 42Ln, respectively. The outputs of the amplification circuits 42L1 to 42Ln are added by an adder 43L and is supplied to an adder 47L through a left REF filter 44L. For example, here, n may be "9". This is the same in the following description. The delay circuit 41 delays the audio input signal by predetermined delay times and outputs a plurality of delay signals from the output sections TLi (i=1 . . . , n). That is, the CPU 200 reads from the coefficient memory circuit 300 the delay coefficients corresponding to the position which is instructed by the joystick 101 and supplies to the delay circuit 41. Thereby, the output portions TLi of the delay circuit 41 are selected and the n delay signals which are delayed by predetermined delay times are obtained from the output portions TLi, respectively. Each of the delay times in the delay circuit 41 indicates a time difference from a time when a response of an original sound of the head acoustic transfer function reaches the left ear to a time when a response of the i-th reflection sound to the head acoustic transfer function reaches the left ear. The delay signal from each of the output portions TLi of the delay circuit 41 is supplied to the amplifier 42Li.

The amplifier 42Li amplifies the inputted signal. For example, the amplifier 42Li can be composed using a multiplier. The CPU 200 reads amplification coefficients corresponding to the position which is instructed by the joystick 101 from the coefficient memory circuit 300 and supplies to the amplifier 42Li. Thereby, the amplitude of the response of the i-th reflection sound at the left ear is reproduced. The outputs of the amplifiers 42Li are supplied to the adder 43L.

The adder 43L adds the signals from the amplifiers 42Li. Thereby, the plurality of signals corresponding to the first to n-th reflection sounds are synthesized. The output of the adder 43L is supplied to the left REF filter 44L.

The left REF filter 44L is the filter by which the head acoustic transfer function of the reflection sound for the left ear is approximated. The left REF filter 44L can be composed of a k-th order IIR-type filter ($0<k\leqq 10$, for example k=6). The CPU 200 reads the filter coefficients corresponding to the position which is instructed by the joystick 101 from the coefficient memory circuit 300 and supplies to the left REF filter 44L. The signal from the adder 43L is filtered in accordance with the filter coefficients by the left REF filter 44L and is supplied to the adder 47L.

The adder 47L adds the signal from the amplifier 46L and the signal from the left REF filter 44L. This addition result is the first channel signal L1 and when a speaker is used, it is outputted to the control section 12. When a headphone is used, the first channel signal L1 is supplied to the headphone without any processing in the control section 12.

The section which is composed of the output portions TLi of the above delay circuit 41, the amplifiers 42Li and the adder 43L is equivalent to an n-th order FIR-type filter. Therefore, this circuit section is structured such that the n-th order FIR-type filter and the k-th order IIR-type filter which is connected to the FIR-type filter in series. Supposing that n is "9", the audio sensitivity can be obtained which is almost the same as the audio sensitivity when convolution of about 2000 steps is calculated using the FIR-type filter. Of course, the precision of the positioning of the virtual sound source can be increased if n is increased. Here, the FIR-type filter outputs a sequence of pulses of a finite number, i.e., a number determined in accordance with the order to the one input impulse. On the other hand, the IIR-type filter can output a sequence of pulses of infinite number theoretically (However, the [IR-type filter is generally designed in such a manner that the output is converged into a sequence of pulses of a number). Therefore, the circuit in which the FIR-type filter and the IIR-type filter are connected in series can output a sequence of pulses of infinite number and is possible to perform the processing equivalent to that of a high-order FIR-type filter.

Because the structure and operation on the second channel signal are the same as those of the above-mentioned first channel signal, the description will be omitted. However, the coefficients which are supplied to the circuit section for the second channel signal may be the same as those which are supplied to the circuit section for the first channel signal or may be different. The above signals L1 and R1 are supplied to the weighting circuit 53 shown in FIG. 31. The weighting circuit 53 inputs the signals L1 and R1 from the first signal processing circuit 52-1 and the signals L2 and R2 from the second signal processing circuit 52-2, and performs the weighting of these signals in accordance with the coefficients from the coefficient read circuit 200. For example, the weighting circuit 53 multiplies the signals L1 and R1 by the weighting coefficient K1 and the signals L2 and R2 by the weighting coefficient K2. For example, the weighting coefficients are determined to satisfy the following equation (2).

$$K1+K2=1 \tag{2}$$

That is, the amplitudes of one of the set of signals L1 and R1 and the set of signals L2 and R2 are controlled to become small if the amplitudes of the others become large and to become large if the amplitudes of the others become small. The signals by which the weight coefficients have been multiplied in this way, are added on either one of the left and right sides to generate the first and second channel signals, respectively. That is, the signal L1 and the signal L2 are added such that the first channel signal is generated, and the signal R1 and the signal R2 are added such that the second channel signal is generated. These first and second channel signals are outputted to the control section 12 in response to a request. The weighting circuit 53 follows the movement of the joystick 101 to generate the weight coefficients K1 and K2 and changes them one after another.

The operation when the position of the virtual sound source is changed from the position A into the position B in accordance with the instruction from the joystick 101 will be described with reference to FIG. 34 as an example. It is assumed that the coefficients for the 90-degree position are set in the first circuit section of the circuit shown in FIG. 31 and the virtual sound source position A is specified. Also, it is assumed that the weight coefficient K1 to the virtual sound source position A is set in "1.0". On the other hand, the coefficients for the 80-degree position are set in the second circuit section shown in FIG. 31 and the virtual sound source position B is specified. Also, it is assumed that the weight coefficient K2 to the virtual sound source position B is set in "0.0". In this state, because the first and second channel signals corresponding to the signals L1 and R1 from the first signal processing circuit 52-1 are generated, the virtual sound source is positioned at the 90-degree position.

If the joystick 101 is moved toward an 80-degree position, the weighting circuit 53 follows the movement of the joystick such that the weight coefficient K1 for the signals L1 and R1 is reduced in order as "1.0→0.9→0.8→0.7→ . . . ". At the same time, the weight coefficient K2 of the signals L2 and R2 is increased in order as "0.0→0.1→0.2→ . . . ". When the joystick 101 reaches the 80-degree position, the weight coefficient K1 becomes "0.0" and weight coefficient K2 becomes "1.0". Thus, the virtual sound source position moves from the 90-degree position to the 80-degree position so as to follow the movement of the joystick 101 and is positioned at the 80-degree position.

In this state, the coefficients for the 90-degree position are set in the first signal processing circuit 52-1 to specify the virtual sound source position A. Also, the weight coefficient K1 for the virtual sound source position A is "0.0". On the other hand, the coefficients for the 80-degree position are set in the second signal processing circuit 52-2 and the virtual sound source position B is instructed. Also, the weight coefficient K2 to the virtual sound source position B is "1.0"

Consider that the joystick 101 is further moved from this state to the 100-degree position. In this case, the virtual sound source moves to the 100-degree position via the 90-degree position. The coefficient read circuit 200 reads the coefficients for the 90-degree position from the coefficient memory circuit 300 and performs the processing to set them in the signal processing circuit corresponding to the signal to which the weight coefficient of zero is applied, i.e., (the first signal processing circuit 52-1 in case of this example). However, because the coefficients for the 90-degree position are already set in the first signal processing circuit 52-1, this processing is omitted.

The weighting circuit 53 follows the movement of the joystick 101 to increase the weight coefficient K1 of the signals L1 and R1 in order as "0.0→0.2→0.3→0.4→ . . . ". At the same time, the weighting circuit 53 decreases the weight coefficient K2 of the signals L2 and R2 in order as "1.0→0.9→0.8→ . . . ". Then, when the joystick 101 reaches the 90-degree position, the weight coefficient K1 becomes "1.0" and the weight coefficient K2 becomes "0.0". In this manner, the virtual sound source position moves from the 80-degree position to the 90-degree position while following the movement of the joystick 101.

In this state, the coefficient read circuit 200 reads the coefficients for the 100-degree position from the coefficient memory circuit 300 and sets them in the second signal processing circuit 52-2. Because the joystick 101 is continuously moved to the 100-degree position, the weighting circuit 53 follows the movement to decrease the weight coefficient K1 in order as "1.0→0.9→0.8→0.7→ . . . ". At the same time, the weighting circuit 53 increases the weight coefficient K2 in order as "0.0→0.1→0.2→ . . . ". When the joystick 101 reaches the 100-degree position, the weight coefficient K1 becomes "0.0" and the weight coefficient K2 becomes "1.0". Thereby, the virtual sound source follows the movement of the joystick 101 to move from the 80-degree position to the 100-degree position via the 100-degree position and is positioned in the 100-degree position.

In this state, the coefficients for the 90-degree position are set in the first signal processing circuit 52-1 and the virtual sound source position A is instructed. Also, the weight coefficient K1 for the virtual sound source position A is "0.0". On the other hand, the coefficients for the 100-degree position are set in the second signal processing circuit 52-2 and the virtual sound source position B is specified. Also, the weight coefficient K2 for the virtual sound source position B is "1.0".

Consider that the joystick is further moved to a 105-degree position. The coefficient read circuit 200 reads the coefficients for the 110-degree position from the coefficient memory circuit 300 and sets them in the first signal processing circuit 52-1. The weighting circuit 53 follows the movement of the joystick 101 to increase the weight coefficient K1 of the signals L1 and R1 in order as "0.0→0.1→0.2→0.3→ . . . ". At the same time, it decreases the weight coefficient K2 of the signals L2 and R2 in order as "1.0→0.9→0.8→ . . . ". When the joystick 101 reaches the 105-degree position, the weight coefficient K1 becomes "0.5" and weight coefficient K2 also becomes "0.5". In this manner, the virtual sound source position moves from the 100-degree position to the 105-degree position while following the movement of the joystick 101 and is positioned in the 105-degree position. The above description indicates the example that the virtual sound source is moved on the concentric circle in accordance to the operation of the joystick 101.

However, the weighting circuit 53 may be composed such that the virtual sound source position moves from the specific position A to another position B in a linear manner in accordance with the movement of the joystick 101. The coefficient of the 90-degree position is supposed to be set in the first signal processing circuit 52-1 now and the virtual sound source position A is supposed to be instructed. Also, the weight coefficient for the virtual sound source position A is supposed to be set in "1.0". On the other hand, the coefficients for the 270-degree position is supposed to be set in the second signal processing circuit 52-2 and the virtual sound source position B is supposed to be instructed. Also, the weight coefficient for the virtual sound source position B is supposed to be set in "0.0". In this state, because the first and second channel signals corresponding to the signals L1 and L2 from the first signal processing circuit 52-1 are outputted from the virtual sound source positioning apparatus, the virtual sound source is positioned in the 90-degree position.

If the joystick 101 is moved to the 270-degree position in this state, the weighting circuit 53 follows the movement to decrease the weight coefficient K1 of the signals L1 and R1 in order as "1.0→0.9→0.8→0.7→ . . . ". At the same time, the weighting circuit 53 increases weight coefficient K2 of the signals L2 and R2 in order as "0.0→0.1→0.2→ . . . ". When the joystick 101 reaches the 270-degree position, the weight coefficient K1 becomes "0.0" and the weight coefficient K2 becomes "1.0". Thereby, the virtual sound source position follows the movement of the joystick 101 and the virtual sound source position straightly moves from the 90-degree position to the 270-degree position and is positioned in the 270-degree position.

As described above, according to the fourth embodiment, because the signal to have imitated the transfer function of a reflection sound is included in the signals L1 and R1 and the signals L2 and R2 in addition to the signal to have imitated the head acoustic transfer function of the direct sound, the clear virtual sound source position is obtained as well as the sound with reality.

Also, in the first and second signal processing circuits 52-1 and 52-2, the j-th order IIR-type filter ($0<j<10$) is used in the left HRTF filter 45L and the right HRTF filter 45R and the left REF filter 44L and the right REF filter 44R. Further, because a k-th, e.g., ninth order filter is used in the FIR-type filter composed of the delay circuit 41, the amplifier 42Li and the adder 43L, or the delay circuit 41, the amplifier 42Ri and the adders 43R, it is possible to very greatly reduce the memory capacity necessary to compose the delay circuit and the quantity of the filter coefficients to be prepared, compared to the conventional virtual sound source positioning apparatus using the FIR-type filter.

Further, because one delay circuit 41 having the plurality of output portions TL0 to TLn and TR0 to TRn is provided to take out necessary signals, it is not necessary to provide a plurality of unit delay circuits unlike the conventional apparatus. Therefore, in a case where the delay circuit is composed in hardware, the quantity of hardware can be decreased and in a case where the delay circuit is composed of a RAM, the capacity of the RAM can be decreased.

Furthermore, according to the fourth embodiment, because the weighting coefficient of a predetermined value, For example, "0", is supplied to the first or second signal processing circuits 52-1 or 52-2, which does not contribute to the generation of the first and second channel signals, the noise never generates to the first and second channel signals.

In the above description, the case that the virtual sound source position is moved on the one concentric circle was described. However, the virtual sound source position may be moved from the position on the one concentric circle to a position on another concentric circle. In this case, in addition to the joystick 101, the operation element 103 for instructing the distance from the listener (a kind of concentric circle) and an operation element 102 for instructing the position in the upper or lower direction are used to instruct a target position of the virtual sound source.

Also, the case where the virtual sound source positioning apparatus is composed of two signal processing circuits (the first and second signal processing circuits 52-1 and 52-2) was described. However, the virtual sound source positioning apparatus may be composed of equal to or more than three signal processing circuits. In this case, the control for moving the virtual sound source position in a more complex manner becomes possible.

Next, the virtual sound source positioning apparatus according to the fifth embodiment will be described. In the fifth embodiment, a control section 12 is added to the sound image positioning apparatus according to the above fourth embodiment. The structure of the control section 12 is the same as the circuit shown in FIG. 3. In FIG. 3, the left channel signal Lin corresponds to the first channel signal and the right channel signal Rin corresponds to the second channel signal. These left and right channel signals Lin and Rin are obtained from the weighting circuit 53 in the fourth embodiment. Thus, if the virtual sound source positioning apparatus which was described in the fourth embodiment further includes the control section 12, because the virtual sound source for the audio input signal can be positioned on a position other than the region between the speakers in the 2-channel speaker reproduction, it is possible to extend the sound field to a large extent.

Next, the virtual sound source positioning apparatus according to the sixth embodiment of the present invention will be described. For example, the virtual sound source positioning apparatus which positions the virtual sound source by giving each of the delay circuits, the filters and the amplifiers predetermined coefficients is disclosed in the above Japanese Laid Open Patent Disclosure (JP-A-Heisei 4-56600). However, in the virtual sound source positioning apparatus which is disclosed in the reference, because the reflection sound is not considered at all which reaches the ear of the Listener from the sound source, there is a problem of lack of reality. The virtual sound source positioning apparatus according to the fifth embodiment of the present invention positions the virtual sound source out of the head of the headphone listener. Also, the virtual sound source can be positioned on a position other than the region between the speakers to the speaker listener. Moreover, the virtual sound source positioning apparatus can extend the sound field. Hereinafter, the sixth virtual sound source positioning apparatus of the present invention will be described. At the sixth embodiment, it is supposed that the virtual sound source positioning apparatus generates the first channel signal for the left ear and the second channel signal for the right ear from an audio input signal.

Figure 35:
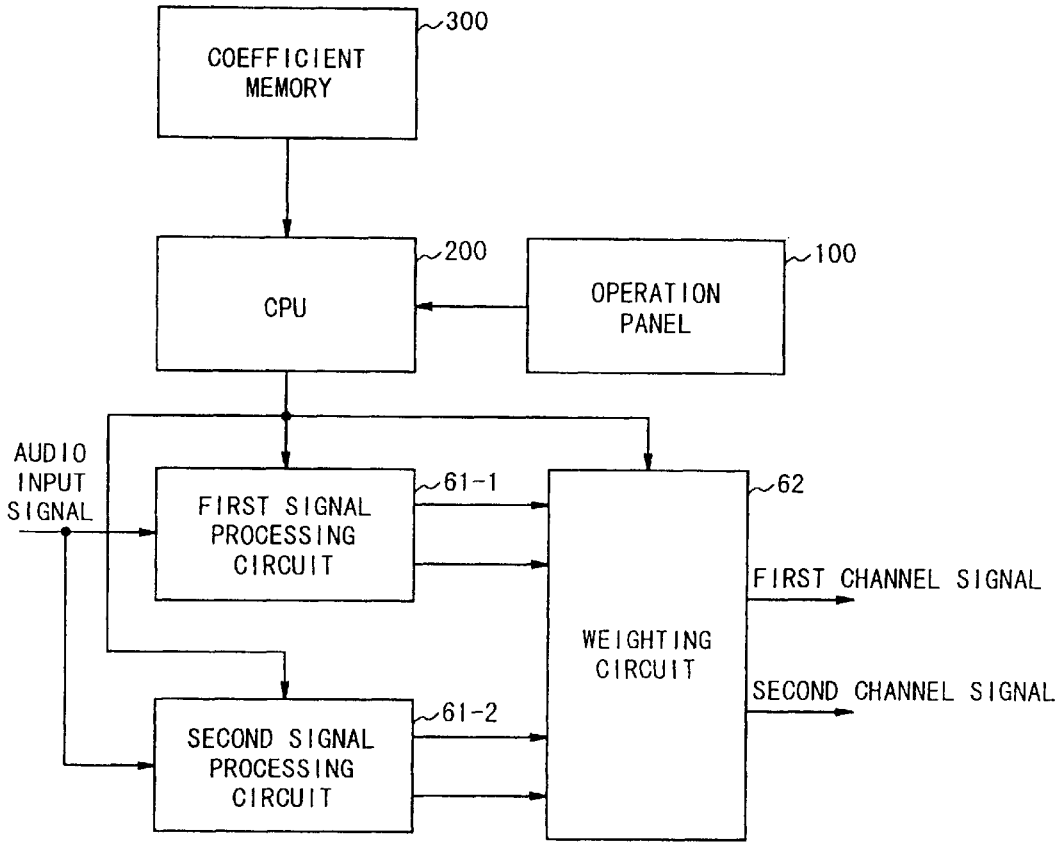
FIG. 35 is a block diagram illustrating the structure of the virtual sound source positioning apparatus according to a fifth embodiment of the present invention.

FIG. 35 is a block diagram illustrating the structure of the channel signal generating section 10 of the virtual sound source positioning apparatus in the sixth embodiment of the present invention. In the sixth embodiment, the channel signal generating section 10 includes a coefficient memory circuit 300, a coefficient read circuit 200 composed of a CPU, an operation panel as an instructing circuit 100, a first signal processing circuit 61-1, a second signal processing circuit 61-2, and a weighting circuit 62.

Figure 36:
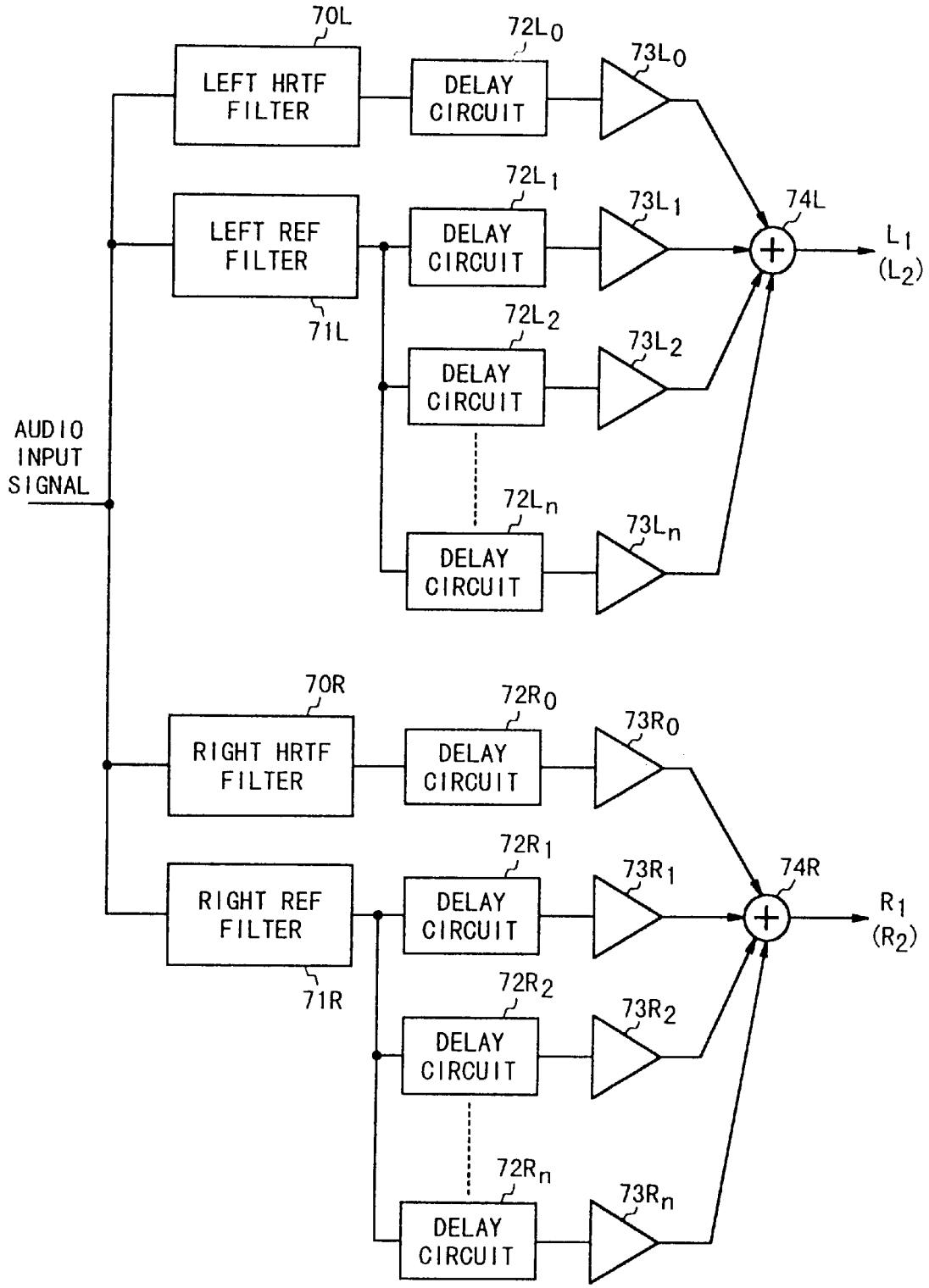
FIG. 36 is a block diagram illustrating the detailed structure of the virtual sound source positioning apparatus according to the fifth embodiment of the present invention.

As shown in FIG. 36, the first signal processing circuit 61-1 in the sixth embodiment is composed of an HRTF filter 70L for the left, a delay circuit 72L0 and an amplifier 73L0. The left HRTF filter 70L is the filter to represent the first head acoustic transfer function of the left ear. The left HRTF filter 70L for the left ear can be composed with a j-th order IIR-type filter ($0<j\leqq 10$, e.g., j=8). The CPU 200 reads the filter coefficients corresponding to the position which is instructed by the instructing circuit 100 from the coefficient memory circuit 300 and supplies them to the left HRTF filter 70L for the left ear. The filtering of the audio input signal according to the filter coefficients is accomplished in the left HRTF filter 70L for the left and the filtering result is supplied to the delay circuit 72L0.

The delay circuit 72L0 delays the inputted signal. As the delay circuit 72L0, the well-known delay circuit can be used which is composed as a predetermined delay time is obtained using the RAM (not illustrated). Hereinafter, the delay circuit composed in this way is referred to as "the RAM delay circuit" The CPU 200 reads the delay coefficients corresponding to the position which is instructed by the instructing circuit 700 from the coefficient memory circuit 300 and supplies them to the delay circuit 72L0. Thereby the delay time of the delay circuit 72L0 is determined. The delay time of the delay circuit 72L0 is used to reproduce the time difference between the times when the original sound reaches the left and right ears of the listener, along with the delay time of the delay circuit 72R0. The output of the delay circuit 72L0 is supplied to the amplifier 73L0.

The amplifier 73L0 amplifies the inputted signal. For example, this amplifier 73L0 can be composed using the multiplier. The CPU 200 reads the amplification coefficient corresponding to the position which is instructed by the instructing circuit 100 from the coefficient memory circuit and supplies to the amplifier 73L0. Thus, the amplitude of a response of the original sound at the left ear can be reproduced. The output of the amplifier 73L0 is supplied to the adder 74L. The above first signal processing circuit 61-1 has the structure which processes the audio input signal in the order of the HRTF filter 70L→ the delay circuit 720→ the amplifier 73L0. However, the order of the processing is not limited in the above order and may be optional. For example, the first signal processing circuit 61-1 may be composed as processed in order of the delay circuit 72L0→ the HRTF filter 70L→ the amplifier 73L0.

Further, the first signal processing circuit 61-1 in the sixth embodiment is further composed of a left REF filter 71L, n delay circuits 72Li (i=1, 2 . . . , n), and n amplifiers 73Li (i=1, 2 . . . , n) . For example, here, n may be 9. This is the same in the following description. The Left REF filter 71L is the filter to approximate the first head acoustic transfer function of the reflection sound. The Left REF filter 71L can be composed of a k-th order IIR-type filter ($0<k\leqq 10$, e.g., k=6). The CPU 200 reads the filter coefficients corresponding to the position which is instructed by the instructing circuit 100 from the coefficient memory circuit 300 and supplies them to the left REF filter 71L. The filtering of the audio input signal according to the filter coefficients is accomplished by the Left REF filter 71L and is supplied to the delay circuit 72Li.

The delay circuit 72Li delays the inputted signal. The delay circuit 72Li can be composed of the RAM delay circuit. The CPU 200 reads the delay coefficients corresponding to the position which is instructed by the instructing circuit 100 from the coefficient memory circuit 300 and supplies them to the delay circuit 72Li. Thereby, the delay time of the delay circuit 72Li is determined. The delay time of the delay circuit 72Li corresponds to the time difference from the time when the response of an original sound reaches the left ear to the time when the response of the i-th reflection sound reaches the left ear. The output of the delay circuit 72Li is supplied to the amplifier 73Li.

The amplifier 73Li amplifies the inputted signal. For example, the amplifier 73Li can be composed of a multiplier. The CPU 200 reads the amplification coefficient corresponding to the position which is instructed by the instructing circuit 100 from the coefficient memory circuit 300 and supplies to the amplifier 73Li. In this manner, the amplitude of the response of the i-th reflection sound at the left ear is reproduced. The output of the amplifier 73Li is supplied to the adder 74L. It is supposed that the audio input signal is processed in order of the left REF filter 71L→ delay circuit 72Li→ amplifier 73Li. However, the order of the processing is not limited to the above and may be optional.

The adder 74L adds the signal from the amplifier 73L0 and the signal from the amplifier 73Li. The adding result is outputted as the first channel signal.

The circuit section composed by a part of the above delay circuit 72Li, the amplifier 73Li and the adder 74L form the filter of the n-th order FIR-type filter. Therefore, the circuit section may be composed of the j-th order IIR-type filter and the n-th order FIR-type filter which is connected to the IIR-type filter in series.

Supposing that n is "9", the precision of the virtual sound source positioning can be achieved with the same precision when the convolution of the about 2000 steps in the IIR-type filter is calculated. In this manner, the precision of the virtual sound source positioning can be improved if the value of n is increased, of course. Here, the FIR-type filter outputs a sequence of finite pulses in accordance with the seven inputting impulses. On the other hand, the IIR-type filter outputs a sequence of pulses of an infinite number theoretically (however, the IIR-type filter is generally designed such that the number of pulses is finite). Therefore, the circuit in which the FIR-type filter and the IIR-type filter are connected in series can output the sequence of pulses of the infinite number. Thus, it could be understood that the processing equivalent to that of the high order FIR-type filter is possible.

The circuit section of generating the second channel signal in the first signal processing circuit 61-1 is composed of a right HRTF filter 70R, a delay record 72R0 and an amplifier 73R0, as shown in FIG. 36.

The right HRTF filter 70R is the filter to represent the second head acoustic transfer function of the right ear. The right HRTF filter 70R for the right ear can be composed with a j-th order IIR-type filter ($0<j\leqq 10$, e.g., j=8). The CPU 200 reads the filter coefficients corresponding to the position which is instructed by the instructing circuit 100 from the coefficient memory circuit 300 and supplies them to the right HRTF filter 70R for the right ear. The filtering of the audio input signal according to the filter coefficients is accomplished in the right HRTF filter 70R and the filtering result is supplied to the delay circuit 72R0.

The delay circuit 72R0 delays the inputted signal. As the delay circuit 72R0, the well-known delay circuit can be used which is composed as a predetermined delay time is obtained using the RAM (not illustrated). Hereinafter, the delay circuit composed in this way is referred to as "the RAM delay circuit". The CPU 200 reads the delay coefficients corresponding to the position which is instructed by the instructing circuit 700 from the coefficient memory circuit 300 and supplies them to the delay circuit 72R0. Thereby the delay time of the delay circuit 72R0 is determined. The delay time of the delay circuit 72R0 is used to reproduce the time difference between the times at which the original sound reaches the left and right ears of the listener, along with the delay time of the delay circuit 72L0. The output of the delay circuit 72R0 is supplied to the amplifier 73R0.

The amplifier 73R0 amplifies the inputted signal. For example, this amplifier 73R0 can be composed using the multiplier. The CPU 200 reads the amplification coefficient corresponding to the position which is instructed by the instructing circuit 100 from the coefficient memory circuit and supplies to the amplifier 73R0. Thus, the amplitude of a response of the original sound at the right ear can be reproduced. The output of the amplifier 73R0 is supplied to the adder 74R. The above second signal processing circuit 61-2 has the structure which processes the audio input signal in the order of the HRTF filter 70R→ the delay circuit 720→ the amplifier 73R0. However, the order of the processing is not limited in the above order and may be optional. For example, the first signal processing circuit 61-2 may be composed as processed in order of the delay circuit 72R0→ the HRTF filter 70R→ the amplifier 73R0.

Further, the second signal processing circuit 61-2 in the sixth embodiment is further composed of a right REF filter 71R, n delay circuits 72Ri ($i=1, 2 \ldots, n$; $0<n\leqq 10$), and n amplifiers 73Ri ($i=1, 2 \ldots, n$; $0<n\leqq 10$). For example, here, n may be 9. This is the same in the following description. The right REF filter 71R is the filter to approximate the first head acoustic transfer function of the reflection sound. The right REF filter 71R can be composed of a k-th order IIR-type filter ($0<k\rightarrow 10,\rightarrow$e.g., k=6). The CPU 200 reads the filter coefficients corresponding to the position which is instructed by the instructing circuit 100 from the coefficient memory circuit 300 and supplies them to the right REF filter 71R. The filtering of the audio input signal according to the filter coefficients is accomplished by the right REF filter 71R and is supplied to the delay circuit 72Ri.

The delay circuit 72Ri delays the inputted signal. The delay circuit 72Ri can be composed of the RAM delay circuit. The CPU 200 reads the delay coefficients corresponding to the position which is instructed by the instructing circuit 100 from the coefficient memory circuit 300 and supplies them to the delay circuit 72Ri. Thereby, the delay time of the delay circuit 72Ri is determined. The delay time of the delay circuit 72Ri corresponds to the time difference from the time when the response of an original sound reaches the right ear to the time when the response of the i-th reflection sound reaches the right ear. The output of the delay circuit 72Ri is supplied to the amplifier 73Ri.

The amplifier 73Ri amplifies the inputted signal. For example, the amplifier 73Ri can be composed of a multiplier. The CPU 200 reads the amplification coefficient corresponding to the position which is instructed by the instructing circuit 100 from the coefficient memory circuit 300 and supplies to the amplifier 73Ri. In this manner, the amplitude of the response of the i-th reflection sound at the right ear is reproduced. The output of the amplifier 73Ri is supplied to the adder 74R. It is supposed that the audio input signal is processed in order of the right REF filter 71R→delay circuit 72Ri→amplifier 73Ri. However, the order of the processing is not limited to the above and may be optional.

The adder 74R adds the signal from the amplifier 73R0 and the signal from the amplifier 73Ri. The adding result is outputted as the second channel signal.

In this manner, the second signal processing circuit 61-2 is composed in the same manner as the first signal processing circuit 61-1. However, various coefficients are different between the first and second signal processing circuits. The weighting circuit 62 is composed like the weighting circuit 53 in the fifth embodiment and acts in the same way.

The first and second channel signals which are outputted from the weighting circuit 62 may be supplied to the headphone just as they are. Thus, the virtual sound source can be positioned out of the head of the headphone listener. Also, those signals may be supplied to the control section 12 which is shown in FIG. 3. In this case, the virtual sound source can be positioned on a position other than the region between the speakers to the speaker listener. Further, the extension of sound and the attendance sense can be obtained.

What is claimed is:

1. A virtual sound source positioning apparatus comprising:

channel signal generating means for generating first and second channel signals, a first component signal indicative of a component of said first channel signal, and a second component signal indicative of a component of said second channel signal from a 1-channel audio input signal;

control means including a low pass filter, for generating a difference signal associated with a difference between said first component signal and said second component signal, filtering said difference signal by said low pass filter to generate a filtered difference signal, and for generating a first audio image control signal from said filtered difference signal and said first channel signal and a second audio image control signal from said second channel signal and said filtered difference signal; and sound output means for positioning a virtual sound source in accordance with said first and second audio image control signals, wherein said control means further includes delay means for delaying said filtered difference signal by first and second predetermined delay times to generate a first delayed filtered difference signal for the first audio image control signal and a second delayed filtered difference signal for the second audio image control signal, respectively, wherein said first and second audio image control signals are generated from said first and second channel signals and said first and second delayed filtered difference signals, respectively.

2. A virtual sound source positioning apparatus according to claim 1, wherein said control means further includes multiplying means for multiplying said first and second component signals by predetermined multiplication coefficients to generate first and second multiplication component signals, respectively, wherein said difference signal is indicative of a difference between said first and second multiplication component signals.

3. A virtual sound source positioning apparatus according to claim 1, wherein said first channel signal is a first composite sound signal of a first direct sound signal and a first reflection sound signal and said second channel signal is a second composite sound signal of a second direct sound signal and a second reflection sound signal.

4. A virtual sound source positioning apparatus according to claim 3, wherein said first component signal is said first direct sound signal and said second component signal is said second direct sound signal.

5. A virtual sound source positioning apparatus according to claim 4, wherein said channel signal generation means includes:

first signal processing means for processing said audio input signal using a first head acoustic transfer function to generate said first composite sound signal as said first channel signal composed of said first direct sound signal and said first reflection sound signal; and second signal processing means for processing said audio input signal using a second head acoustic transfer function to generate said second composite sound signal as said second channel signal composed of said second direct sound signal and said second reflection sound signal.

6. A virtual sound source positioning apparatus according to claim 5, wherein said first signal processing means includes a first j-th order IIR-type filter ($0<j\leqq 10$) for generating said first direct sound signal, and said second signal processing means includes a second j-th IIR-filter for generating said second direct sound signal.

7. A virtual sound source positioning apparatus according to claim 5 wherein said first signal processing means includes a first k-th order IIR-type filter ($0<k\leqq 10$) for generating said first reflection sound signal, and a first m-th order FIR-type filter ($0<m$) which is connected in series with said first k-th IIR-type filter, and said second signal processing means includes a second k-th order IIR-type filter for generating said second reflection sound signal, and a second m-th order FIR-type filter which is connected in series with said second k-th IIR-type filter.

8. A virtual sound source positioning apparatus according to claim 1, wherein said first component signal is said first channel signal and said second component signal is said second channel signal.

9. A virtual sound source positioning apparatus according to claim 8, wherein said channel signal generating means includes:

first signal processing means for processing said audio input signal using a first head acoustic transfer function to generate said first composite sound signal as said first channel signal composed of said first direct sound signal and said first reflection sound signal; and second signal processing means for processing said audio input signal using a second head acoustic transfer function to generate said second composite sound signal as said second channel signal composed of said second direct sound signal and said second reflection sound signal.

10. A virtual sound source positioning apparatus according to claim 9, wherein said first signal processing means includes a first j-th order IIR-type filter ($0<j\leqq 10$) for generating said first direct sound signal, and said second signal processing means includes a second j-th IIR-type filter for generating said second direct sound signal.

11. A virtual sound source positioning apparatus according to claim 9, wherein said first signal processing means includes a first k-th order IIR-type filter ($0<k\leqq 10$) for generating said first reflection sound signal, and a first m-th order FIR-type filter ($0<m$) which is connected in series with said first k-th IIR-type filter, and said second al processing means includes a second k-th order IIR-type filter for generating said second reflection sound signal, and a second m-th order FIR-type filter which is connected in series with said second k-th IIR-type filter.

12. A virtual sound source positioning apparatus according to claim 1, wherein said channel signal generating means includes:

first processing means for generating said first and second channel signals and said first and second component signals from said 1-channel audio input signal, and said channel signal generating means further includes:

second processing means for generating third and fourth channel signals and third and fourth component signals respectively indicative of components of said third and fourth channel signals from said 1-channel audio input signal, wherein a ratio of said first channel signal to said third channel signal is k1: k2, and a ratio of said second channel signal to said fourth channel signal is k1: k2, and wherein said control means further includes:

means for generating said difference signal associated with a difference between a summation of said first component signal and said third component signal and a summation of said second component signal and said fourth component signal, generating said first audio image control signal from said first delayed filtered difference signal, said first channel signal and said third channel signal, and generating said second audio image control signal from said second delayed filtered difference signal, said second channel signal and said fourth channel signal.

13. A virtual sound source positioning apparatus according to claim 12, wherein said channel signal generating means further includes weighting means of weighting said audio input signal such that the ratio of said first channel signal to said third channel signal is k1:k2 and the ratio of said second channel signal to said fourth channel signal is k1:k2.

14. A virtual sound source positioning apparatus according to claim 13, wherein when said virtual sound source is positioned on a first position, $k1=1$ and $k2=0$ and said first processing means is set in a first state corresponding to said first position, and wherein said virtual sound source positioning apparatus further includes:

instructing means for issuing an instruction to move said virtual sound source from said first position to a second position;

setting means for setting said second processing means to a second state corresponding to said second position in response to said instruction; and changing means for changing said k1 and k2 such that a relation of ($k1+k2=1$) is satisfied.

15. A virtual sound source positioning apparatus according to claim 12 wherein said channel signal generating means further includes weighting means of weighting said first to fourth channel signals such that the ratio of said first channel signal to said third channel signal is k1:k2 and the ratio of said second channel signal to said fourth channel signal is k1:k2.

16. A virtual sound source positioning apparatus according to claim 15, wherein when said virtual sound source is positioned on a first position, k1=1 and k2=0 and said first processing means is set in a first state corresponding to said first position, and wherein said virtual sound source positioning apparatus further includes:

instructing means for issuing an instruction to move said virtual sound source from said first position to a second position;

setting means for setting said second processing means to a second state corresponding to said second position in response to said instruction; and changing means for changing said k1 and k2 such that a relation of (k1+k2=1) is satisfied.

17. A virtual sound source positioning apparatus according to claim 12 wherein said first processing means includes:

first signal processing means for processing said audio input signal using a first head acoustic transfer function to generate a first composite sound signal as said first channel signal composed of a first direct sound signal and a first reflection sound signal, and for processing said audio input signal using a second head acoustic transfer function to generate a second composite sound signal as said second channel signal composed of a second direct sound signal and a second reflection sound signal; and second signal processing means for processing said audio input signal using said first head acoustic transfer function to generate a third composite sound signal as said third channel signal composed of a third direct sound signal and a third reflection sound signal, and for processing said audio input signal using said second head acoustic transfer function to generate a fourth composite sound signal as said fourth channel signal composed of a fourth direct sound signal and a fourth reflection sound signal.

18. A virtual sound source positioning apparatus according to claim 17, wherein said first signal processing means includes first and second j-th order IIR-type filters ($0<j\leqq 10$) for generating said first and second direct sound signals, respectively, and said second signal processing means includes third and fourth j-th IIR-type filters for generating said third and fourth direct sound signals, respectively.

19. A virtual sound source positioning apparatus according to claim 17, wherein said first signal processing means includes a first k-th order IIR-type filter ($0<k\leqq 10$) for generating said first reflection sound signal, a first m-th order FIR-type filter ($0<m$) which is connected in series with said first k-th IIR-type filter, a second k-th order IIR-type filter for generating said second reflection sound signal, and a second m-th order FIR-type filter which is connected in series with said second k-th IIR-type filter, and said second signal processing means includes a third k-th order IIR-type filter ($0<k\leqq 10$) for generating said third reflection sound signal, a third m-th order FIR-type filter ($0<m$) which is connected in series with said third k-th IIR-type filter, a fourth k-th order IIR-type filter for generating said fourth reflection sound signal, and a fourth m-th order FIR-type filter which is connected in series with said fourth k-th IIR-type filter.

20. A virtual sound source positioning apparatus according to claim 1, wherein said control means further includes multiplying means for multiplying said first and second component signals by predetermined multiplication coefficients to generate first and second multiplication component signals, respectively, wherein said difference signal is indicative of a difference between said first and second multiplication component signals.

21. A virtual sound source positioning apparatus according to claim 1, wherein said first channel signal is a first composite sound signal of a first direct sound signal and a first reflection sound signal and said second channel signal is a second composite sound signal of a second direct sound signal and a second reflection sound signal.

22. A virtual sound source positioning apparatus according to claim 1, wherein said first component signal is said first channel signal and said second component signal is said second channel signal.

23. A virtual sound source positioning apparatus according to claim 22, wherein said channel signal generating means includes:

first signal processing means for processing said audio input signal using a first head acoustic transfer function to generate said first composite sound signal as said first channel signal composed of said first direct sound signal and said first reflection sound signal; and second signal processing means for processing said audio input signal using a second head acoustic transfer function to generate said second composite sound signal as said second channel signal composed of said second direct sound signal and said second reflection sound signal.

24. A virtual sound source positioning apparatus according to claim 23, wherein said first signal processing means includes a first j-th order IIR-type filter ($0<j\leqq 10$) for generating said first direct sound signal, and said second signal processing means includes a second j-th IIR-type filter for generating said second direct sound signal.

25. A virtual sound source positioning apparatus according to claim 23, wherein said first signal processing means includes a first k-th order IIR-type filter ($0<k\leqq 10$) for generating said first reflection sound signal, and a first m-th order FIR-type filter ($0<m$) which is connected in series with said first k-th IIR-type filter, and said second signal processing means includes a second k-th order IIR-type filter for generating said second reflection sound signal, and a second m-th order FIR-type filter which is connected in series with said second k-th IIR-type filter.

* * * * *

UNITED STATES PATENT AND TRADEMARK OFFICE

CERTIFICATE OF CORRECTION

PATENT NO. : 6,091,894
DATED : July 18, 2000
INVENTOR(S) : Akihiro Fujita, Kenji Kamada, Kouji Kuwano It is certified that error appears in the above-identified patent and that said Letters Patent is hereby corrected as shown below:

Column 32,
Line 14, replace "second al processing" with -- second signal processing --.

Signed and Sealed this

Second Day of April, 2002

*Attest:*

*Attesting Officer*

JAMES E. ROGAN
*Director of the United States Patent and Trademark Office*